US010753035B2

(12) United States Patent
Kim et al.

(10) Patent No.: US 10,753,035 B2
(45) Date of Patent: Aug. 25, 2020

(54) LAUNDRY TREATMENT APPARATUS AND CONTROLLING METHOD THEREOF

(71) Applicant: LG Electronics Inc., Seoul (KR)

(72) Inventors: Chungil Kim, Seoul (KR); Jaeseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 189 days.

(21) Appl. No.: 15/903,452

(22) Filed: Feb. 23, 2018

(65) Prior Publication Data

US 2018/0245275 A1 Aug. 30, 2018

(30) Foreign Application Priority Data

Feb. 24, 2017 (KR) ..... 10-2017-0025017

(51) Int. Cl.

| | |
|---|---|
| ***D06F 58/30*** | (2020.01) |
| ***D06F 58/02*** | (2006.01) |
| ***D06F 58/26*** | (2006.01) |
| *D06F 25/00* | (2006.01) |
| *D06F 103/00* | (2020.01) |
| *D06F 103/36* | (2020.01) |
| *D06F 105/24* | (2020.01) |

(52) U.S. Cl.

CPC ..... *D06F 58/30* (2020.02); *D06F 58/02* (2013.01); *D06F 58/26* (2013.01); *D06F 25/00* (2013.01); *D06F 2103/00* (2020.02); *D06F 2103/36* (2020.02); *D06F 2105/24* (2020.02); *D06F 2204/065* (2013.01); *D06F 2212/02* (2013.01)

(58) Field of Classification Search

CPC ..... D06F 58/28; D06F 58/02; D06F 58/26; D06F 58/30; D06F 2204/065; D06F 2105/24; D06F 25/00; D06F 2103/00; D06F 2212/02

USPC ..... 34/606

See application file for complete search history.

(56) References Cited

U.S. PATENT DOCUMENTS

| | | | | |
|---|---|---|---|---|
| 4,549,362 | A * | 10/1985 | Haried | D06F 58/263 34/395 |
| 5,006,778 | A * | 4/1991 | Bashark | G01R 31/2825 318/799 |
| 5,525,277 | A * | 6/1996 | Joseph | B29C 55/28 264/40.6 |
| 6,141,887 | A * | 11/2000 | Chen | D06F 58/30 34/475 |
| 10,492,585 | B2 * | 12/2019 | Weatherly | A45D 20/00 |
| 2005/0193977 | A1 * | 9/2005 | Hata | F02D 11/105 123/350 |

(Continued)

*Primary Examiner* — Edelmira Bosques
*Assistant Examiner* — Bao D Nguyen
(74) *Attorney, Agent, or Firm* — Fish & Richardson P.C.

(57) ABSTRACT

A laundry treatment apparatus in accordance with the present disclosure includes a drum configured to accommodate laundry, an air channel through which air is flowed into or out of the drum, a fan configured to put pressure on air in the air channel for flowing of the air, a fan motor configured to rotate the fan and being controlled by adjusting of a RPM, an abnormal airflow detection unit disposed on the air channel and configured to detect whether an abnormal state of airflow is occurred, and a controller configured to cause the RPM of the fan motor to be increased. The controller configured to cause laundry to be dried by rotating the fan motor at a predetermined base RPM, and to cause the RPM to be increased if the abnormality of airflow is detected by the abnormal airflow detection unit while the fan motor is rotating.

20 Claims, 19 Drawing Sheets

(56) References Cited

U.S. PATENT DOCUMENTS

2006/0152178 A1* 7/2006 Carow ..... D06F 58/30 318/66
2006/0201020 A1* 9/2006 Cimetta ..... D06F 58/30 34/468
2006/0242858 A1* 11/2006 Beaulac ..... D06F 58/30 34/446
2006/0288605 A1* 12/2006 Carow ..... D06F 58/30 34/446
2006/0288608 A1* 12/2006 Carow ..... D06F 58/30 34/604
2007/0227036 A1* 10/2007 Powers ..... D06F 58/30 34/606
2007/0251119 A1* 11/2007 Kim ..... D06F 58/30 34/546
2007/0271809 A1* 11/2007 Martin ..... D06F 58/30 34/90
2008/0005926 A1* 1/2008 Goggin ..... D06F 58/20 34/605
2008/0209751 A1* 9/2008 Asciolla ..... D06F 58/30 34/89
2008/0282568 A1* 11/2008 Oh ..... D06F 58/30 34/72
2009/0145001 A1* 6/2009 Oh ..... D06F 58/22 34/282
2009/0211111 A1* 8/2009 Kim ..... D06F 58/263 34/526
2009/0249643 A1* 10/2009 Harpenau ..... D06F 58/30 34/524
2010/0000118 A1* 1/2010 Cunningham ..... D06F 58/20 34/487
2010/0045472 A1* 2/2010 Siddall ..... D06F 58/22 340/626
2013/0145645 A1* 6/2013 Kim ..... F26B 21/003 34/480
2013/0219735 A1* 8/2013 Beaumont ..... D06F 58/22 34/82
2014/0338213 A1* 11/2014 Stegerwald ..... D06F 58/04 34/130
2015/0322617 A1* 11/2015 Asciolla ..... F26B 21/12 34/427
2016/0265153 A1* 9/2016 Kim ..... D06F 58/30
2016/0316884 A1* 11/2016 Ben-Hur ..... A45D 20/16

* cited by examiner

LAUNDRY TREATMENT APPARATUS AND CONTROLLING METHOD THEREOF

CROSS-REFERENCE TO RELATED APPLICATIONS

This application claims priority to Korean Patent Application No. 10-2017-0025017, filed on Feb. 24, 2017, the entire contents of which is hereby incorporated by reference in its entirety.

TECHNICAL FIELD

The present disclosure relates to a laundry treatment apparatus with a drying function and a method of controlling the same.

BACKGROUND

A laundry treatment apparatus capable of drying laundry dries wet laundry by applying dry air. The laundry treatment apparatus includes an air channel and a drum for accommodating laundry. The laundry treatment apparatus includes a heater for dehumidifying and heating air flowed into through the air channel and a fan disposed on the air channel and putting pressure for flowing of air. It is also known that a conventional laundry treatment apparatus includes a filter disposed on the air channel and filtering foreign substances from air.

The laundry treatment apparatus is classified into a laundry treatment apparatus equipped with an exhaust type drying system and a laundry treatment apparatus equipped with a circulation type drying system in accordance with how air to be supplied to laundry is treated after exchanging heat with the laundry. Moreover, there is another laundry treatment apparatus equipped with a hybrid system in which air inside a drum is partially exhausted, and the remaining air is re-supplied to the drum through circulation.

The air channel of the laundry treatment apparatus equipped with the exhaust type drying system or the hybrid system includes an exhaust duct which provides a passage for exhausting of air inside the drum outside.

Meanwhile, there is a case where the laundry treatment apparatus is used in an environment in which a system duct connected to multiple exhaust ducts is provided. In this case, multiple laundry treatment apparatuses share one system duct. In this environment, all of the air discharged from multiple laundry treatment apparatuses is guided through the one system duct. For example, the system duct which is connected to multiple laundry treatment apparatuses is installed in a place such as a laundry shop which commercially uses the laundry treatment apparatus. As another example, there is a case where the system duct which is connected to multiple laundry treatment apparatuses which are disposed at each room or layer such as in a dormitory or the like having multiple rooms or layers is installed.

SUMMARY

It is a first object of the present disclosure to provide a laundry treatment apparatus capable of causing a preset drying function to equally be performed even if flow resistance in the air channel is varied.

In the related art, there is a problem that, in a case where flow resistance in the air channel is tentatively increased, the drying process is not progressed while showing an error state, and thus results in inconvenience. For example, in a case where multiple laundry treatment apparatuses which share a system duct exhaust air simultaneously, flow resistance in the air channels of each multiple laundry treatment apparatus is tentatively increased, and in this case the drying process is not progressed while showing an unconditional error state, and thus results in a great inconvenience to users. It is therefore a second object of the present disclosure to solve this problem.

In the related art, there is a problem that, in a case where the air channel is partially blocked up, this troublesome cannot automatically be solved. It is therefore a third object of the present disclosure to solve this problem.

In a case where flow resistance in the air channel is increased because any part or unit of the laundry treatment apparatus is out of order or some foreign substances are heavily accumulated on the filter, repair to the part or unit, or cleaning or replacing of the filter is required, and thus the laundry treatment apparatus is required a corresponding operation such as alerting information regarding this problem to a user. It is a fourth object of the present disclosure to cause an operation responsive to the error to selectively be performed as well as to achieve the first to third objects.

It is a fifth object of the present disclosure to continuously supply a suitable amount of air according to the amount of the laundry.

It is a sixth object of the present disclosure to secure safety by preventing overheating of a heater.

It is a seventh object of the present disclosure, in a case where flow resistance is decreased again after it has tentatively increased, to adjust an amount of air according to this.

Objects, features and advantages in accordance with some embodiments of the invention will be limited to the above objects.

Technical Solution

To achieve the first object, in a case where a determination is made that flow resistance is increased, the laundry treatment apparatus according to an embodiment of the present disclosure adjusts a RPM of a fan motor.

To achieve the second object, the laundry treatment apparatus according to an embodiment of the present disclosure performs a drying process corresponding to a situation in which flow resistance is tentatively increased.

To achieve the third object, in a case where flow resistance is increased, the laundry treatment apparatus according to an embodiment of the present disclosure increases a RPM of a fan motor and thus puts a high pressure on foreign substances or the like caused an air channel to be partially blocked.

To achieve the fourth object, in a case where flow resistance is increased, the laundry treatment apparatus according to an embodiment of the present disclosure selects and performs at least one of an operation responsive to the error and a RPM adjusting of the fan motor based on a predetermined condition.

To achieve the fifth object, the laundry treatment apparatus according to an embodiment of the present disclosure includes a presetting of a suitable base RPM of the fan motor according to an amount of the laundry.

To achieve the sixth object, the laundry treatment apparatus according to an embodiment of the present disclosure detects an abnormal state of airflow, and thus performs an operation corresponding to a result of the detection.

To achieve the seventh object, the laundry treatment apparatus according to an embodiment of the present disclosure decreases or recovers the RPM of the fan motor if a predetermined condition for recovering of the RPM is satisfied.

To achieve the above objects, a laundry treatment apparatus in accordance with one aspect of the present disclosure includes a drum accommodating laundry, an air channel through which air is flowed into or out from the drum, a fan disposed on the air channel and a fan motor rotating the fan. To achieve the above objects, a controlling method of treating laundry in accordance with another aspect of the present disclosure includes a dry start step for starting the drying of laundry by rotating a fan motor with a base RPM, and a RPM control step for increasing the RPM of the fan motor if it is determined that airflow is in an abnormal state during rotating of the fan motor.

To achieve the above objects, a laundry treatment apparatus in accordance with yet another aspect of the present disclosure includes a drum configured to accommodate laundry, an air channel through which air is flowed into or out from the drum, a fan configured to put pressure on air in the air channel for flowing of the air, a fan motor configured to rotate the fan and being controlled by adjusting of a RPM, an abnormal airflow detection unit disposed on the air channel and configured to detect if the abnormal state of airflow is occurred, and a controller which controls that drying of the laundry can be started by rotating a fan motor with a base RPM, and that the RPM of the fan motor can be increased if the abnormal state of airflow is detected by the abnormal airflow detection unit during rotating of the fan motor.

Advantageous Effects

In accordance with an embodiment of the present disclosure, the operation of a preset drying process of the laundry treatment apparatus is equally performed in spite of a change of external circumstances or flow resistance, by maintaining a suitable airflow rate by adjusting the RPM of the fan motor according to the flow resistance.

The laundry treatment apparatus according to an embodiment of the present disclosure is configured to cause the drying process of the laundry treatment apparatus to be possibly performed by increasing a RPM in a case where the flow resistance is tentatively increased, and as a result of this, time for the drying operation is saved.

In accordance with an embodiment of the present disclosure, a RPM is automatically adjusted based on flow resistance without manually adjusting of the RPM by a user, and as a result of this, the convenience of the user is increased.

The laundry treatment apparatus according to an embodiment of the present disclosure is configured to put a high pressure on foreign substances or the like caused an air channel to be partially blocked, and thus the foreign substances or the like and the flow resistance can be more successfully removed and the air flow is more easily performed without any stopping or interrupting that.

The laundry treatment apparatus according to an embodiment of the present disclosure is configured to supply a suitable amount of air corresponding to an amount of laundry, and thus optimum performance of drying operations according to an amount of laundry and preventing from over drying are obtained, and power loss that results from supplying an excess amount of air to a small amount of laundry can be prevented.

The laundry treatment apparatus according to an embodiment of the present disclosure is configured to increase to a RPM corresponding to a result of the detection on an abnormality of an amount of air, or perform an operation responsive to the error, and thus overheating of a heater is prevented and safety therefrom is secured.

The laundry treatment apparatus according to an embodiment of the present disclosure is configured to put a higher pressure on air by increasing the RPM of the fan motor if flow resistance is tentatively increased, and decrease or recover the RPM of the fan motor if the flow resistance is normalized again after it has been increased, and thus a suitable amount of air according to the amount of the laundry is continuously supplied and power loss is prevented.

BRIEF DESCRIPTION OF THE DRAWINGS

FIG. 5*a* is a view illustrating that an air flow switch 80 is open (off) in a case where airflow is relatively small (A1), and FIG. 5*b* is a view illustrating that the air flow switch 80 is closed (on) in a case where airflow is relatively large (A2) according to an embodiment of the disclosure.

In FIG. 7, control time points (ra, rb, rc and rd) of changing RPMs are illustrated, and a command RPM (R(t)) is changed at the control time points (ra, rb, rc and rd) according to an embodiment of the disclosure.

FIG. 10*a* illustrates a scenario (①) which performs an operation responsive to the error in a case where the abnormal state of airflow is occurred according to an embodiment of the disclosure. FIG. 10*b* illustrates a scenario (②) which increases and recovers the RPM of the fan motor 52 in a case where the abnormal state of airflow is occurred according to an embodiment of the disclosure.

FIG. 13 illustrates a procedure for selecting a base RPM based on a detected amount of the laundry according to an embodiment of the disclosure.

FIG. 15 illustrates a procedure performed in a case where the fan motor 52 is operated at an n low-level base RPM ($R_{ilow,n}$) selected in FIG. 13 according to an embodiment of the disclosure.

FIG. 16 illustrates RPMs of the fan motor 52 and duty values (D) which are controlled depending on time under a predetermined condition according to one experimental example.

FIGS. 18*a* to 18*d* are flow charts illustrating a first to forth exemplary embodiments respectively.

DETAILED DESCRIPTION

Figure 1:
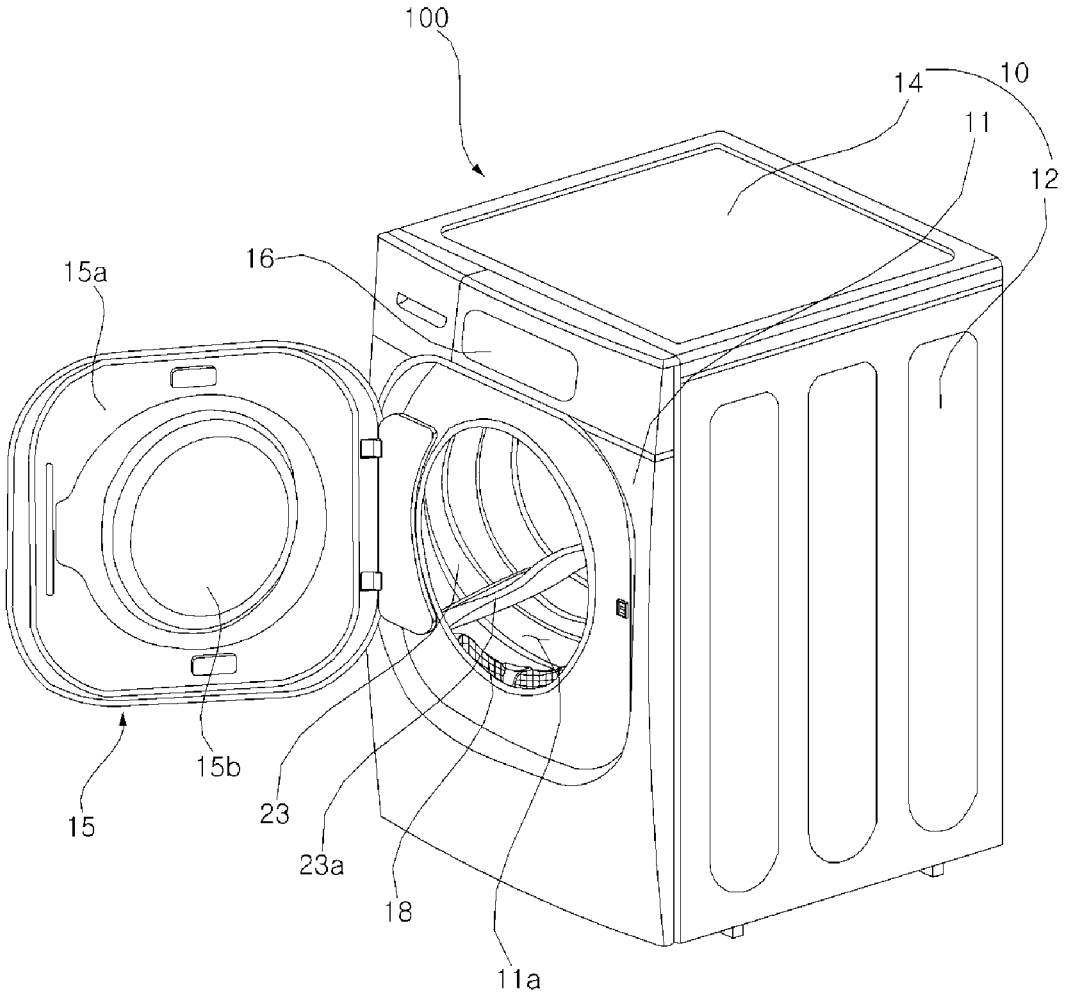
FIG. 1 is a perspective view illustrating a laundry treatment apparatus 100 according to an embodiment of the disclosure.

In the following, the terms representing directions such as "front", "back", "left", right", "upper", "bottom" or the like are utilized to help a better understanding of the invention, and can be different according to criteria defined as well.

In the following, some terms including an expression such as "first", "second", "third" or the like is just utilized to prevent confusion from describing of various embodiments, and therefore elements, parts, or steps including them have no order, importance, priority, master and slave relationship or the like in relation to one another. For example, an apparatus and/or method including only a second element without a first element may be configured or performed.

In a case where comparing of the magnitude having linguistic and/or mathematical expressions is performed in the present disclosure, "less than or equal to" and "less than", or "more than or equal to" and "more than" are easily replaceable with each other by a person skilled in the art, and therefore there is no problem to exert an effect of the laundry treatment apparatus even if replacing with each other is performed.

The term "amount of laundry" is defined to include weight of the laundry accommodated in a drum 23 and/or an amount of water contained in the laundry. Since a level of a RPM in drying operations based on an amount of the laundry is determined, therefore, the larger water is contained in the laundry inside the drum 23, the larger an amount of the laundry can be determined and this determining process can be preset. Since the larger weight of the laundry inside the drum 23 is, the larger water can be contained in the laundry, therefore, the larger weight of the laundry inside the drum 23 is, the larger an amount of the laundry can be determined and this determining process can be preset. An amount of the laundry can be detected by a temperature sensor 32, a humidity sensor 33 or an image sensor or the like of the laundry treatment apparatus, and a level of the amount of the laundry can be directly input by a user. Since an amount of the laundry can be determined by detection through sensors or a user's input, it may not necessarily be proportional to an actual weight or water amount of the laundry, but it may generally be proportional to the weight or water amount of the laundry.

The term 'command RPM (R(t))' used in this disclosure means a RPM value which a fan motor 52 is instructed to output at a specific time (t). For example, the fan motor 52 is controlled by a controller 31. The command RPM (R(t)) may be different to an actual RPM measured in a specific time (t), but since the fan motor 52 will approach the actual RPM through a control algorithm such as a feedback control or the like, that difference may be small.

Figure 7:
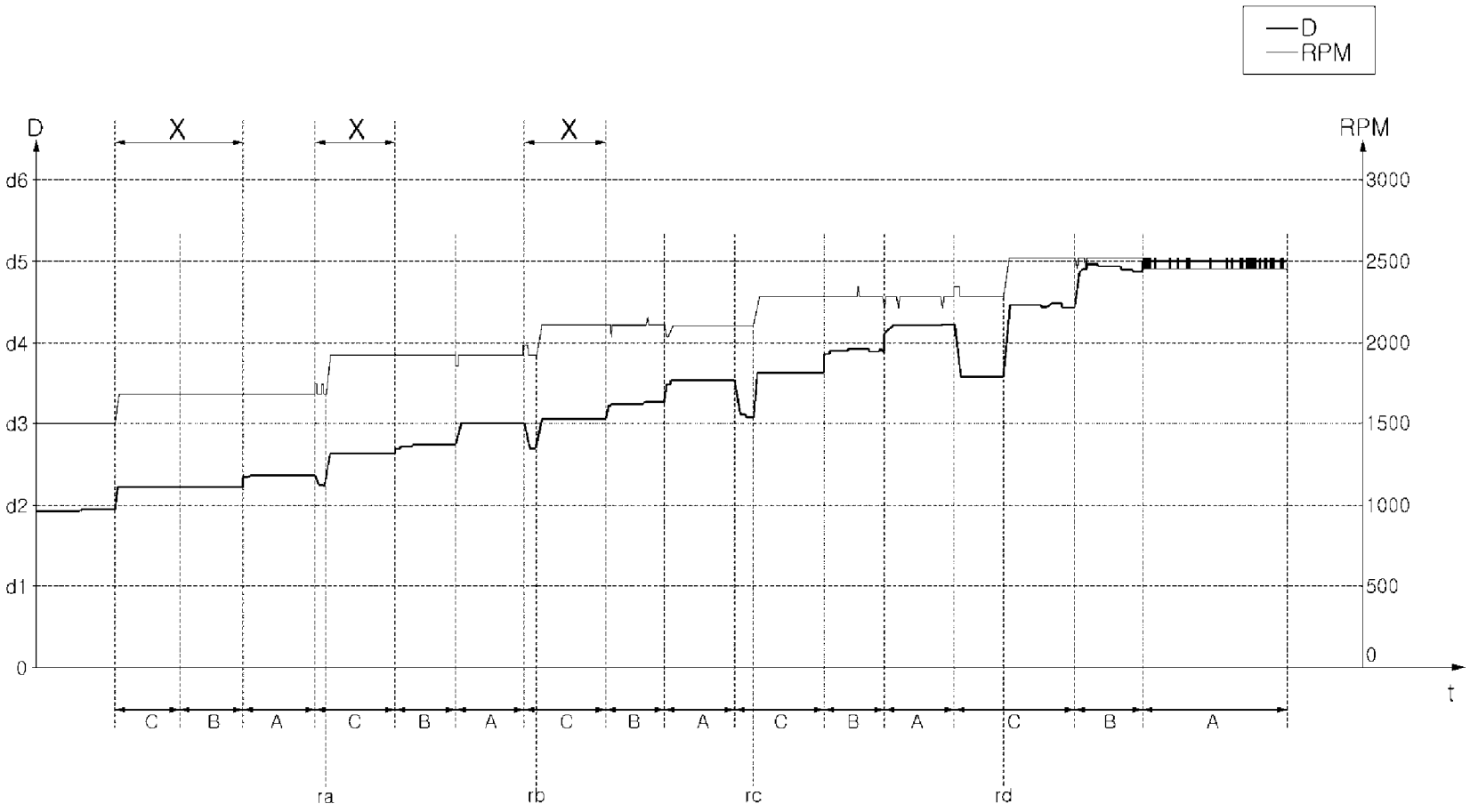
FIG. 7 is a graph illustrating actual RPMs of a fan motor 52 and fan motor duty values (D) which are measured from a condition that exhaust conditions (A, B and C) and a command RPM of a fan motor 52 are differently applied according to time (t) according to an embodiment of the disclosure.
Figure 10A:
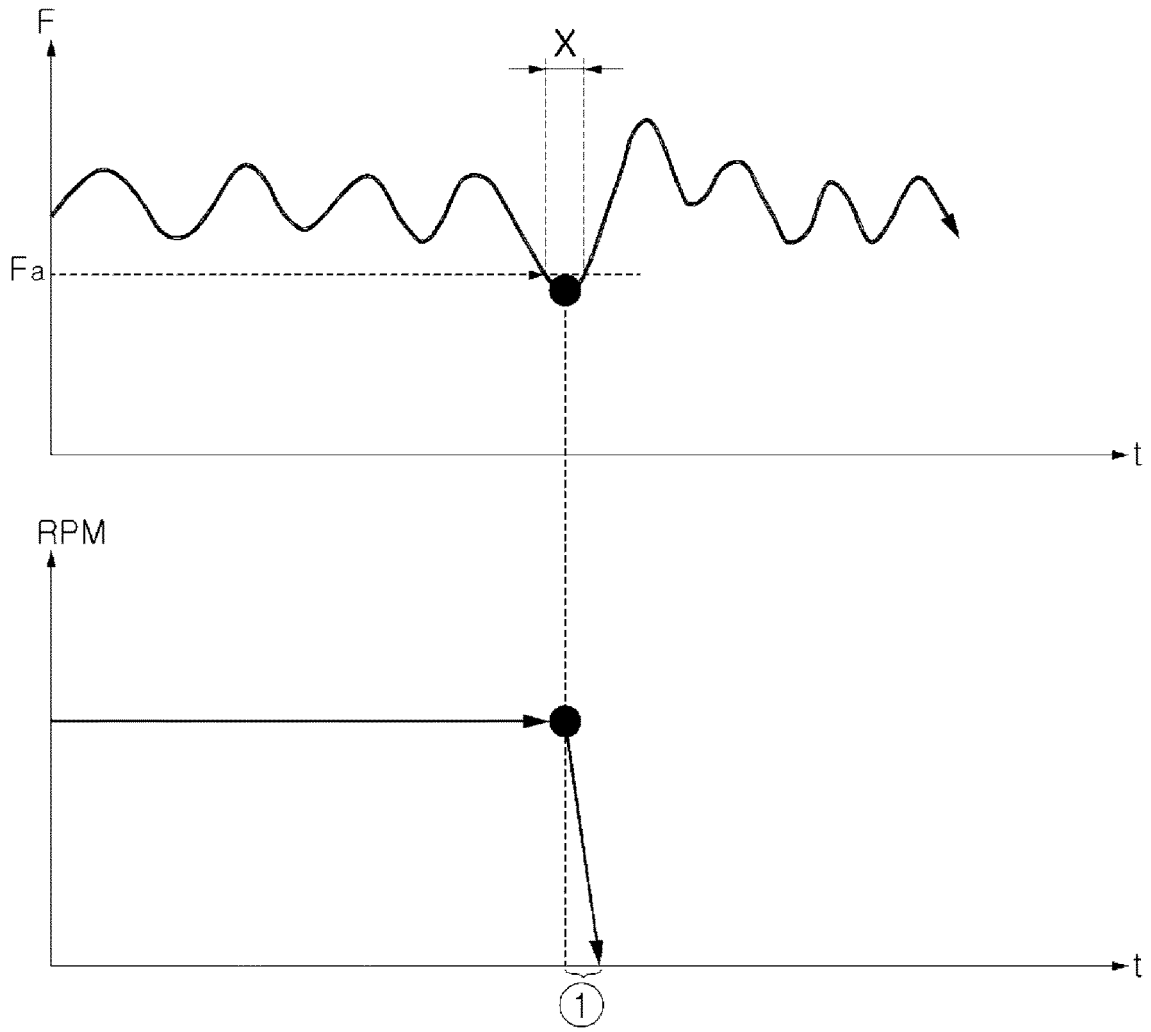
FIGS. 10*a* and 10*b* are graphs showing the RPM of the fan motor 52 which is controlled at the same time as the graph of airflow (F) which varies with time, and illustrate controlling of the RPM of the fan motor 52 in a case where an abnormal state of airflow is occurred in which the airflow (F) is decreased less than or equals to a predetermined value (Fa) according to an embodiment of the disclosure.
Figure 10B:
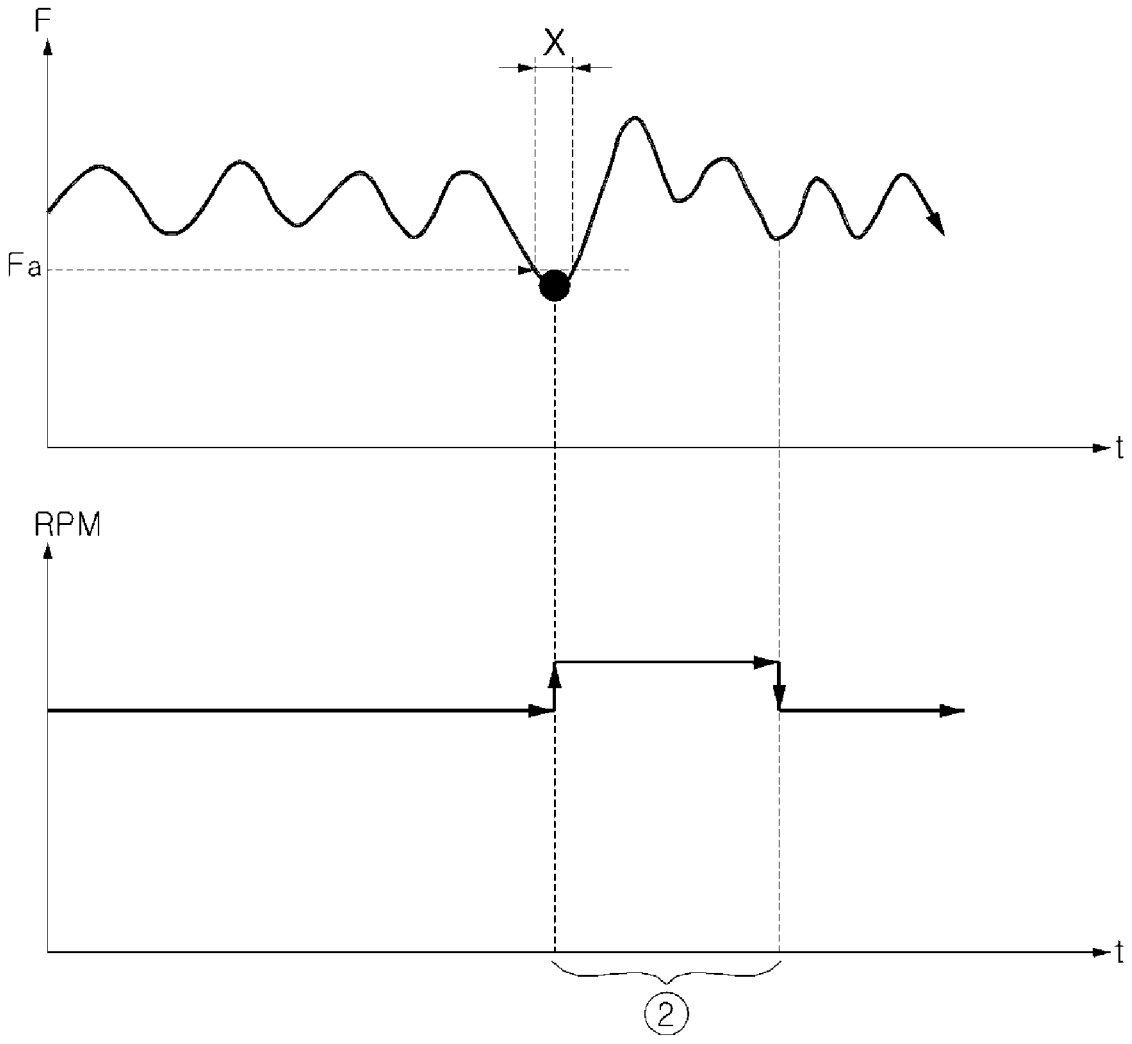
Figure 16:
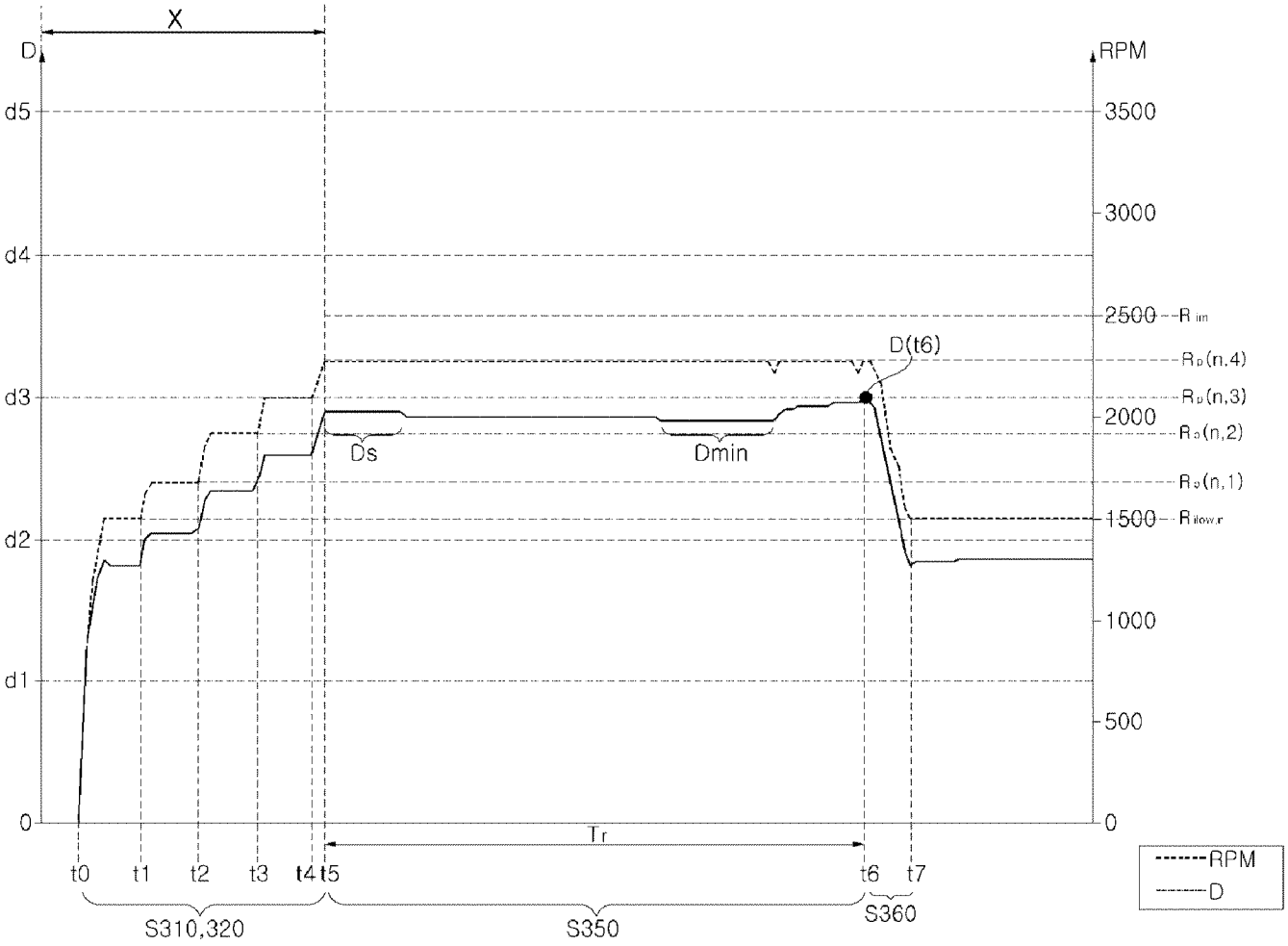
FIG. 16 is a graph illustrating the RPM of the fan motor 52 controlled according to the flow chart illustrated in FIG. 15 according to an embodiment of the disclosure.

The term 'RPM (revolutions per minute)' used in this disclosure is defined to include an actual detected RPM and a command RPM (R(t)) if not specified. The RPMs shown in the graphs of FIGS. 7 and 16 are RPMs actually measured, although it is observed that the RPMs momentarily slightly fluctuate due to the temporary fluctuation of the flow resistance in the air channel 40, and that the actually measured RPMs slightly fluctuate and sharply increase if a command RPM (R(t)) is changed in a stepwise manner, the actually measured RPM generally equals to the command RPM(R(t)). Meanwhile, although the RPM shown in the graphs of FIGS. 10*a* and 10*b* is a command RPM (R(t)), an actually measured RPM will approach the command RPM (R(t)).

The term 'base RPM ($R_i$)' used in this disclosure means a value being preset regardless of airflow (F) or a duty value (D). The base RPM ($R_i$) may be a value being preset for rotating of the fan motor 52 before a RPM of the fan motor 52 is changed for controlling according to a RPM control step S300. The base RPM ($R_i$) may be a value being preset in a dry start step S200. The base RPM ($R_i$) may be a single value, or multiple values preset to be changed according to time. The base RPM ($R_i$) may be preset to be changed according to an amount of the laundry. In accordance with an embodiment, the base RPM ($R_i$) may be separately preset into a maximum base RPM ($R_{imax}$) which is relatively a large value, and a low-level base RPM ($R_{ilow}$) which is relatively a small value. The low-level base RPM ($R_{ilow}$) may be divided into a plurality of low-level base RPMs. In accordance with an embodiment, the low-level base RPM ($R_{ilow}$) includes a first low-level base RPM ($R_{ilow,1}$) to an n low-level base RPM ($R_{ilow,n}$) in ascending order. Hereinafter, n is a natural number.

The term 'increase RPM ($R_p$)' used in this disclosure means a RPM value preset for instructing of the fan motor 52 in a case where it is determined that airflow is in an abnormal state. The increase RPM ($R_p$) may be preset to be larger than the low-level base RPM ($R_{ilow}$) selected in a dry start step S200. A plurality (n) of increase RPMs ($R_p$) may be preset so that an increase RPM ($R_p$) varies according to which one is selected from a plurality (n) of low-level base RPMs ($R_{ilow}$), and thus the drying operation is started. Moreover, a plurality orders (m) of increase RPMs ($R_p$) may be preset so that the RPM of the fan motor 52 can be additionally increased if it is determined that airflow is in an abnormal state in even a state that the RPM of the fan motor 52 is increased to an increase RPM ($R_p$) corresponding to a first level. Hereinafter m is a natural number.

An m-th order increase RPM ($R_{p(n,m)}$) means a RPM value instructed to the fan motor 52 if it is determined that airflow is in an abnormal state in a case where a n low-level base RPM ($R_{ilow,n}$) is selected and thus the drying operation is started, or a RPM value in an m-th order in a case where the RPM of the fan motor 52 is preset to be increased in a stepwise manner if it is determined that airflow is in an abnormal state. For example, the RPM of the fan motor 52 is increased to a first increase RPM ($R_{p(2,1)}$) if it is determined that airflow is in an abnormal state in a case where a second low-level base RPM ($R_{ilow,2}$) is selected. Thereafter, the fan motor RPM can be increased to a second increase RPM ($R_{p(2,2)}$) if it is determined again that airflow is in an abnormal state, and it can be increased to a third increase RPM ($R_{p(2,3)}$) if it is still determined that airflow is in an abnormal state.

The term 'critical condition' used in this disclosure means a condition in which the RPM of the fan motor 52 is not any more increased even if it is determined that airflow is in an abnormal state. For example, the critical condition may be a condition in which a command RPM (R(t)) is greater than a predetermined critical RPM ($R_{lim}$). The critical RPM ($R_{lim}$) may be preset to be changed according to a value being selected in a dry start step S200 from a plurality of low-level base RPMs ($R_{ilow}$). In accordance with an embodiment, the critical RPM ($R_{lim}$) may be preset to 2500 rpms. As in FIG. 15, a procedure S332 for determining whether the critical condition is satisfied in an algorithm of a control method may be included. Alternatively, the command RPM(R(t)) may be preset to be not any more increased, in a case where the last order increase RPM ($R_p$) is preset to become the critical RPM ($R_{lim}$), if the last order increase RPM ($R_p$) reaches a command RPM(R(t)) without a procedure for determining whether the critical condition is satisfied.

Airflow (F) can be measured by a volume of air passing an air channel per hour, such as CFM. Alternatively, airflow (F) can be measured by wind speed of air passing through a section of a particular part of an air channel, such as m/s.

The term 'a condition considered as an abnormal state of airflow' used in this disclosure means a condition in which it is determined that airflow is in an abnormal state. If the condition considered as the abnormal state of airflow is satisfied, it is determined that airflow is in the abnormal state. The abnormal state of airflow may be preset to be satisfied when an amount of air is less that a predetermined value (Fa) The predetermined value (Fa) may be referred to as a base airflow value (Fa). In accordance with an embodiment, an abnormal airflow detection unit 80 is provided in order to determine whether a condition considered as an abnormal state of airflow is satisfied. In accordance with another embodiment, an abnormal airflow detection unit 80 is provided which measures an amount of air in the air channel, such as volume or flow rate per hour in order to determine whether a condition considered as an abnormal state of airflow is satisfied, and compares the measured airflow with the base airflow value (Fa). FIGS. 7, 8, 10*a*, 10*b* and 16 show sections (X) in which it is determined that airflow is in an abnormal state. As shown in FIGS. 7, 8, 10*a*, 10*b* and 16, the sections except for the sections in which it is determined that airflow is in an abnormal state among sections in which the fan motor 52 is being operated are sections in which it is determined that airflow is in a normal state.

The term 'exhaust condition' used in this disclosure means a level of flow resistance.

Figure 9:
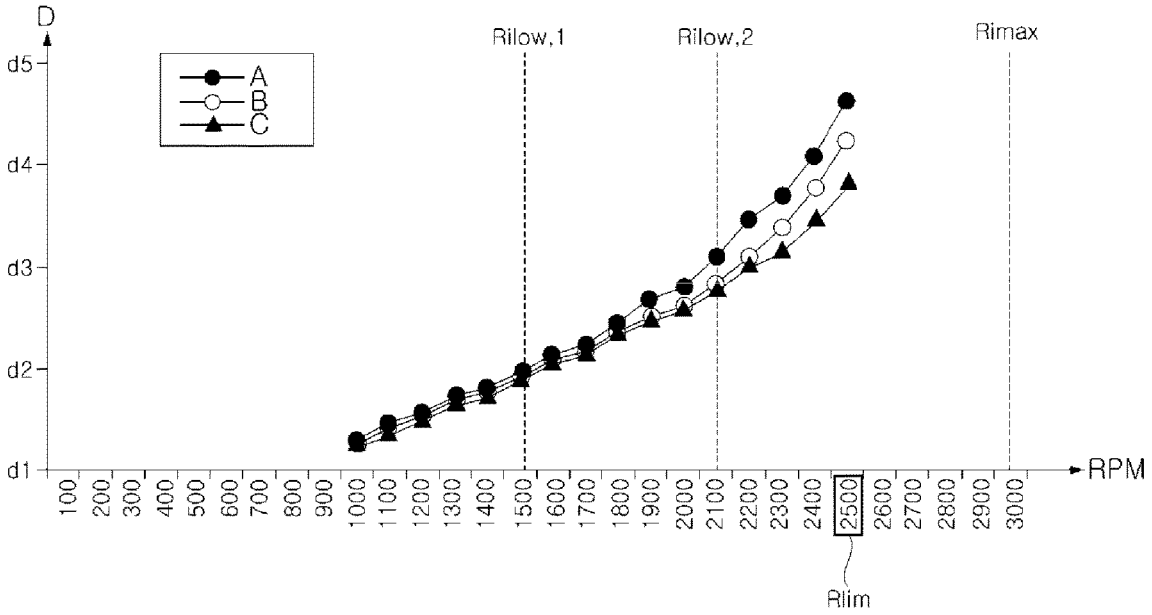
FIG. 9 is a graph illustrating fan motor duty values (D) measured from exhaust conditions (A, B and C) and the RPMs of the fan motor 52 according to an embodiment of the disclosure.

The term 'fan motor duty value (D)' used in this disclosure means a value proportional to power supplied to the fan motor 52. The fan motor duty value (D) may be preset to a value of power itself supplied to the fan motor 52, or a value being obtained by modifying power supplied to the fan motor 52, or a value being calculated from current, voltage and/or the pulse cycle or frequency of a PWM inverter supplied to the fan motor 52. A fan motor duty value (D) is a value being detected or calculated numerically, and, in FIGS. 7, 9, and 16, represented with d1, d2, d3, d4, d5 and d6 (0<d1<d2<d3<d4<d5<d6) instead of a specific number. The fan motor duty value (D) is a value detectable at every time point.

The term 'current duty value (D(t))' used in this disclosure means a duty value most recently detected in a procedure S350 for determining whether a recovering condition is satisfied.

The term 'setting duty value (Ds)' used in this disclosure means a value being calculated based on a fan motor duty value (D) detected in a time section (Tr) in which the fan motor 52 rotates at a constant command RPM (R(t)). The setting duty value (Ds) is a value for determining whether a recovering condition is satisfied. The setting duty value (Ds) may be calculated based on a fan motor duty value (D) in an early portion of a time section (Tr) in which the fan motor 52 rotates at a constant command RPM (R(t)). For example, the setting duty value (Ds) may be preset to be an average value or a representative value based on a predetermined standard of a plurality of fan motor duty values (D) detected in the early portion of the time section (Tr). The time section (Tr) may be a time section in a state where the command RPM (R(t)) reaches an increase RPM ($R_p$)). In accordance with an embodiment, controlling is provided for causing the command RPM (R(t)) to be decreased if a recovering condition is satisfied by determining whether it is satisfied by using the current duty value (D(t)) and the setting duty value(Ds) and the like.

The term 'minimum duty value (Dmin)' used in this disclosure means a minimum value of fan motor duty values (D) detected from the start time to the present time of the time section (Tr).

The term 'reference duty value (Dc, Dc1, Dc2, Dc3, Dc4)' used in this disclosure means a value for determining whether a recovering condition is satisfied. The reference duty value (Dc, Dc1, Dc2, Dc3, Dc4) may be preset to a constant value or a value being varied according to a condition.

Figure 2:
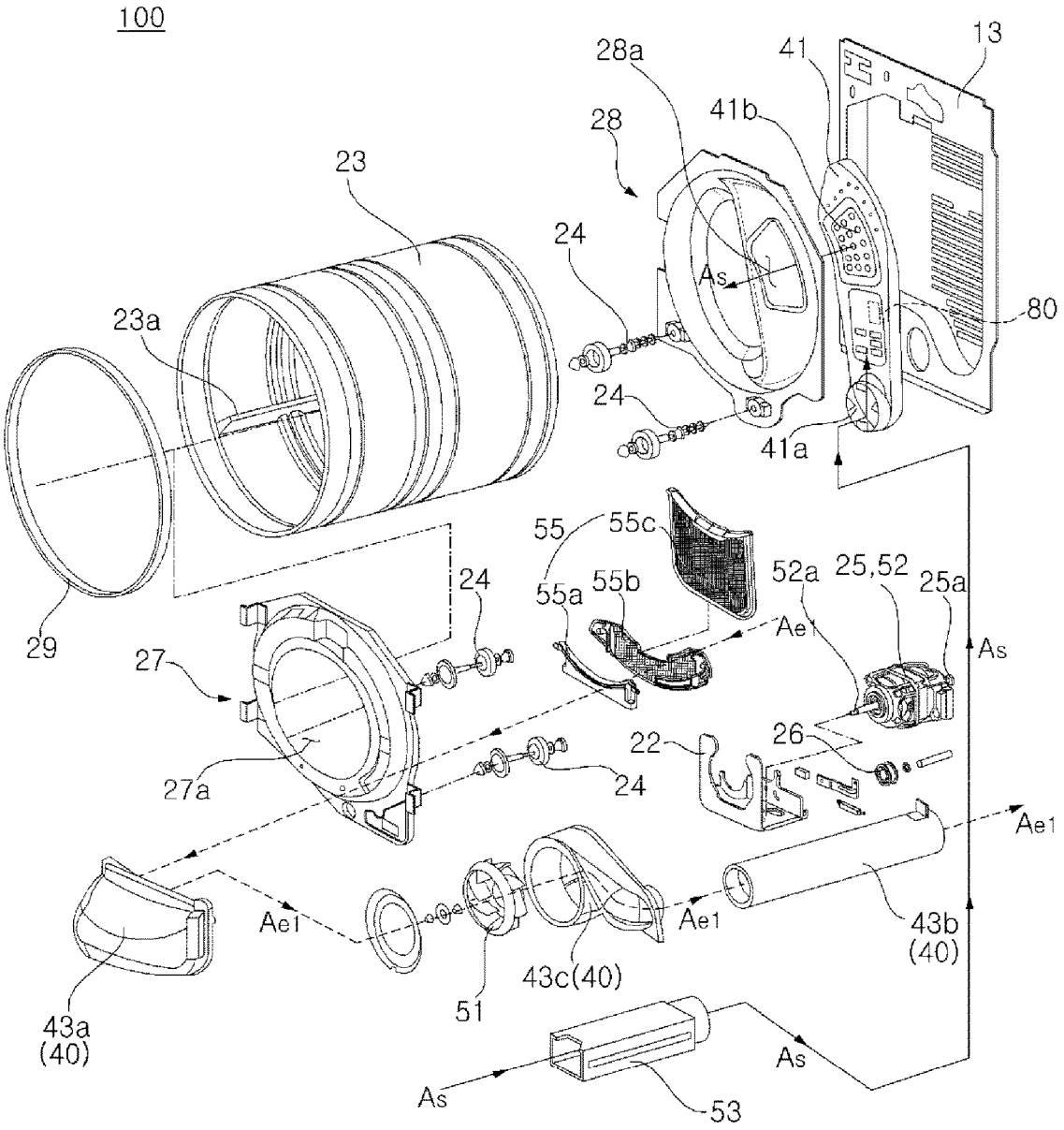
FIG. 2 is an exploded perspective view illustrating internal configurations of the laundry treatment apparatus 100 according to an embodiment of the disclosure.
Figure 3:
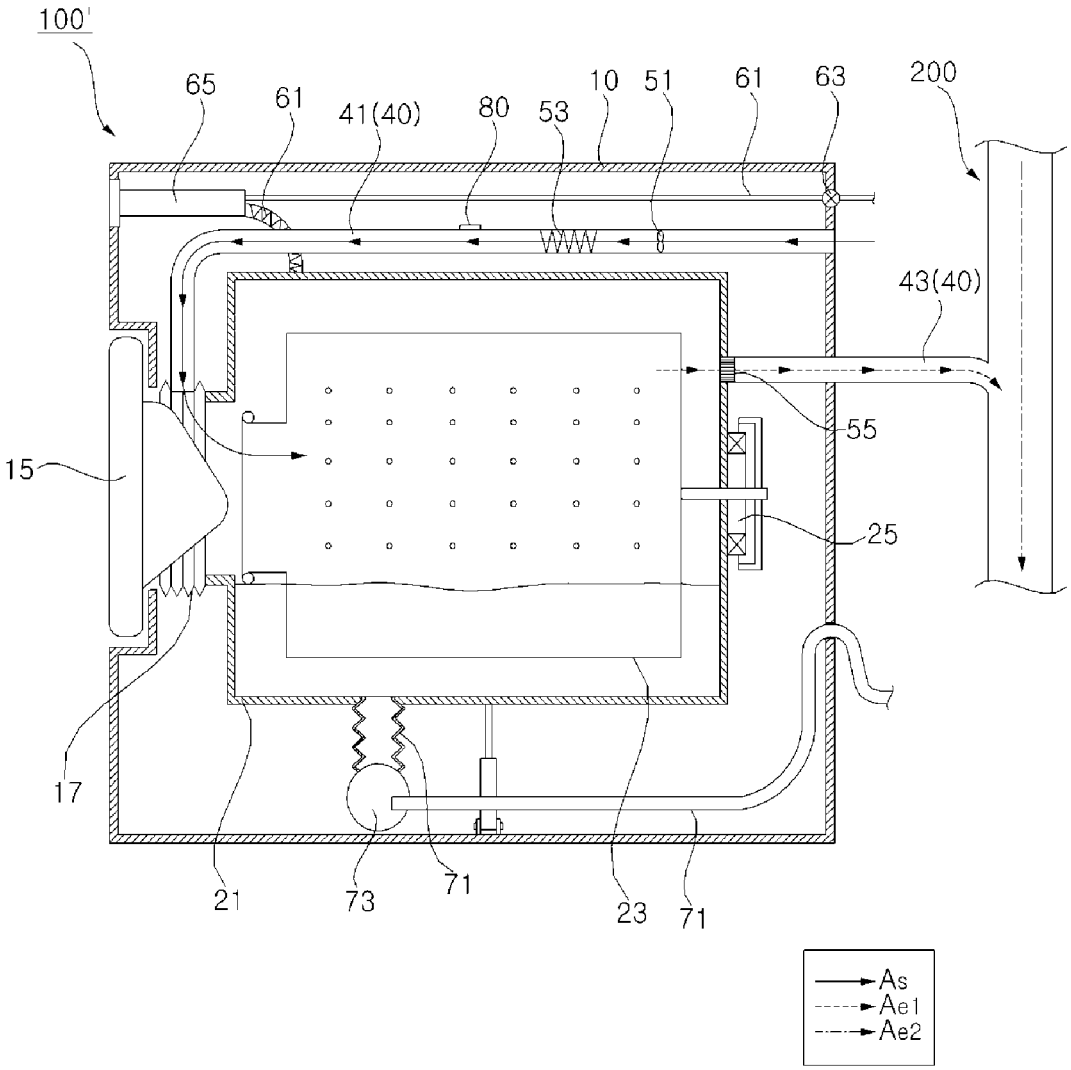
FIG. 3 is a sectional schematic view illustrating a laundry treatment apparatus 100' and a system duct 200 according to an embodiment of the disclosure.

The present invention includes a control method of the laundry treatment apparatus, or a laundry treatment apparatus including a controller for performing the control method and for controlling hardware for processing the method in accordance with an embodiment of the present disclosure, the laundry treatment apparatus may be a washing machine or a drying machine with drying function. FIGS. 1 and 2 illustrate a drying machine 100 in accordance with an embodiment, and FIG. 3 illustrates a washing machine 100' with a drying function in accordance with another embodiment.

A control method in accordance with an embodiment may be implemented with computer programs. In this case, each step of flowcharts and combination of flowcharts may be performed by computer program instructions. The instructions may be stored in a computer (such as, minicomputer) included in a controller 31, and create some means for preforming functions described in each step of a flowchart. The instructions may be stored in a storage medium (such as, a memory) usable in or readable by a computer or the like for implementing a function in a specific manner.

The control method or each step may a part of a module, a segment or a code including at least one executable instruction for implementing specific logic functions. In some embodiments, some functions or features described in each step of the embodiments may possibly be occurred out of order. For example, consecutive two steps may be substantially performed at the same time, or occasionally performed in reverse order according to a corresponding function.

Referring to FIGS. 1 and 2, in accordance with an embodiment of the present disclosure, a laundry treatment apparatus 100 will be described.

The laundry treatment apparatus 100 include a casing 10 forming an external shape. The casing 10 provides an internal space in which a drum 23 and other configurations are deposed. The casing 10 includes a front cover 11 forming a front portion thereof, a side cover 12 forming both side portions thereof, and a back cover 13 forming a back portion thereof. The casing 10 includes a base which forms a bottom surface and supports the laundry treatment apparatus 100. The casing 10 includes a top cover forming a top surface thereof.

The base consists of a flat plate. Cabinets 12 and 13 are integrally formed on the base. The cabinets 12 and 13 are formed into a "ㄷ" shape in which a front portion is opened, and include side and back covers 12 and 13. A top cover 14 is disposed on an upper portion of the cabinets 12 and 13.

The front cover 11 forms a laundry entrance 11*a*. The laundry treatment apparatus 100 includes a door 15 for opening or closing the laundry entrance 11*a*. The door 15 includes a door frame 15*a* rotatably coupled to the front cover 11, and a door glass 15*b* mounted in the door frame 15*a*. The door frame 15*a* has a hole in the center portion thereof, and the door glass 15*b* is mounted in the hole. The door glass 15*b* is made of a transparent member so that the inside of the drum 23 can be seen. The door glass 15*b* has a shape convex toward the inside of the drum 23.

The laundry treatment apparatus 100 includes a control panel 16 disposed at an upper portion of the front cover 11. The control panel 16 includes an output unit 36 for outputting some information including various states regarding the operations of the laundry treatment apparatus 100. The output unit 36 may include a speaker for outputting the information as an audible sound. The output unit 36 may include a display panel for visually displaying the information. The control panel 16 includes an input unit 35 for inputting operation instructions of laundry treatment apparatus 100 from a user. The input unit 35 may include a button, a dial, a touch screen, or the like.

The laundry treatment apparatus includes a drum 23 accommodating laundry. The drum 23 is disposed in a casing 10. The drum 23 is rotatably disposed. The drum 23 has a cylindrical shape of which front and back surfaces are opened, and the front surface is connected to a laundry entrance 11*a*.

A lifter 23 for lifting up the laundry is provided on inner circumferential surface of the drum 23. The lifter 23*a* is protruded from the inner circumferential surface of the drum 23. The lifter 23*a* extends long in the longitudinal direction. A plurality of lifters 23*a* may be disposed at a predetermined angle relative to the center of the drum 23. Lifting up and dropping of the laundry by the lifter 23*a* may be repeated during the rotation of the drum 23.

The laundry treatment apparatus 100 includes front and back supporters 27 and 28 by which the drum 23 is rotatably supported. The front and back supporters 27 and 28 are disposed inside the casing 10. The front supporter 27 supports the front portion of the drum 23. The back supporter 28 supports the back portion of the drum 23. A guider consisted of at least one protrusion or groove which has a ring shape is formed on the front and back supporters 27 and 28. The front and back ends of the drum 23 are engaged with the guider, and as a result of this, the drum 23 can be stably rotated.

Each of the front and back supporters 27 and 28 includes at least one roller 24 supporting the drum 23. An outer circumferential surface of the drum 23 contacts the roller 24.

The laundry treatment apparatus 100 includes at least one motor 25, 52. The laundry treatment apparatus 100 includes a drum motor 25 rotating the drum 23. The laundry treatment apparatus 100 includes a fan motor 52 rotating a fan 51. Referring to FIG. 2, in accordance with an embodiment, at least one double shaft motor 25, 52 which has functions of the drum motor 25 and the fan motor 52 is provided to the laundry treatment apparatus 100. Referring to FIG. 3, in accordance with an embodiment, the drum motor 25 and the fan motor 52 are separately provided to the laundry treatment apparatus 100. The fan motor 52 described in the present disclosure is not limited to a specific type, and therefore any type of configuration is available. A fan motor 52 controlled by changing of a RPM is provided. For example, the fan motor 52 may be a BLDC motor.

The laundry treatment apparatus 100 includes a motor supporting member 22 supporting at least one motor 25, 52. The motor supporting member 22 is mounted on the base. The at least one motor is supported by the motor supporting member 22. The at least one motor 25, 52 provides a driving force for rotating the drum 23. The at least one motor 25, 52 may rotate the fan 51. At least one double shaft motor 25, 52 includes a fan motor shaft 52*a* coupled to the fan 51, a drum motor shaft 25*a* having a driving pulley engaged with a belt 29 which is engaged with the drum 23.

An idle pulley 26 for adjusting tension of the belt 29 is mounted on the motor supporting member 22. The belt 29 in a state where it is engaged with both the driving pulley and the idle pulley 26 covers the outer circumferential surface of the drum 23. In a case where the at least one motor 25, 52 rotates, the belt 29 is transported by the drying pulley, and the drum 23 rotates by the friction between the belt 29 and the drying pulley.

The laundry treatment apparatus 100 includes an air channel 40 which causes air to flow into or out from the drum. The air channel guides that air is flowed into or out from the drum 23.

The air channel 140 includes a supply duct 41 which guides flowing of air into the drum 23. The supply duct 41 may guide air inside or outside the casing 10 into the drum 23. The air channel 40 includes an exhaust duct 43 which guides flowing of air out from the drum 23. The exhaust duct 43 may guide air into the inside or outside of the casing 10.

The laundry treatment apparatus 100 includes a heater 42 heating air flowed into the drum 23. The heater 42 is disposed on the supply duct 41.

The laundry treatment apparatus 100 includes a fan 51 disposed on the air channel 40. The fan 51 is configured to put pressure on air in the air channel for flowing of the air. The fan 51 may be disposed on at least one of the supply duct 41 and the exhaust duct 43. Alternatively, the air channel 40 includes a circulation duct which causes air inside the drum 23 to flow out from the drum 23 and again causes air outside the drum 23 to flow into the drum 23. In this case, the fan 51 and an abnormal airflow detection unit 80 may be disposed on the circulation duct. In accordance with an embodiment, the fan 51 is disposed on the exhaust duct 43. The fan 51 may be provided as a centrifugal fan.

The fan 51 is configured to rotate by the fan motor 52. The fan 51 is configured to be coupled to the fan motor shaft 52*a* of the fan motor 52. In a case where the fan 51 is rotated, a negative pressure acts in the drum 23 due to a suction force of the fan 51, and thus air passed through the supply duct 41 is flowed into the drum 23. Referring to the arrow As of FIG. 2, air heated by a heater 53 is flowed into the heater connection member 41*a* by the supply duct 41, and then supplied into the drum 23 through the outlet 41*b* and the supply member 28*a*.

Air inside the drum 23 by rotating of the fan 51 is flowed into the exhaust duct 43. The front supporter 27 configured to form an exhaust member at a lower portion of the inlet 27*a*, and if the fan 51 is operated, air inside the drum 23 is flowed into the exhaust duct 43 through the exhaust member.

The exhaust duct 43 includes an exhaust start portion 43*a* disposed at an upper portion of the fan 51. The exhaust start portion 43*a* is disposed at a front portion of the exhaust member. The exhaust duct 43 includes an exhaust back portion 43*b* disposed at a lower portion of the fan 51. The exhaust duct 43 includes a fan housing 43*c* accommodating the fan 51, and forming a flow path of air. The fan housing 43*c* is connected to the exhaust start portion 43*a* and the exhaust back portion 43*b*, and thus forms the flow path of air. Referring to the arrow Ae1 of FIG. 2, air passed through the exhaust member sequentially passes through the exhaust start portion 43*a*, the fan housing 43*c* and the exhaust back portion 43*b*, and moves.

The exhaust duct 43 may be configured to extend to the outside of the casing 10. Referring to FIG. 3, the laundry treatment apparatus 100 may be installed in such a using environment that air which has passed through the exhaust duct 43 is flowed into a system duct 200. The arrow Ae2 of FIG. 3 illustrates a flowing direction of air in the system duct 200.

The laundry treatment apparatus 100 includes a filter 55 filtering foreign substances. The filter 55 is configured to filter the foreign substances included in the air flowing through air channel 40. The filter 55 may be provided in the front supporter 27. The filter 55 is configured to filter foreign substances such as lint floating in the air discharged through the exhaust member from the drum 23. The filter 55 includes filter mounts 55*a* and 55*b* which are disposed in the exhaust member. The filter mounts 55*a* and 55*b* are configured to form a filter insertion unit. The filter mounts 55*a* and 55*b* include a front part 55*a* and a back part 55*b* which are combined and disposed in the longitudinal direction. The front part 55*a* is connected to the exhaust member and the back part 55*b* forms multiple holes through which air flows. The filter 55 includes an exchange filter 55*c* detachably inserted through the filter insertion unit 55*c*. The filter insertion unit is open toward the upper side thereof. The exchange filter 55*c* may include a mesh filter with small openings. The exchange filter 55*c* can be pulled up by a user in a state that it is inserted in the filter insertion unit, and then pulled out from the filter insertion unit. In a state that the exchange filter 55*c* is inserted in the filter insertion unit, if the fan 51 is operated, air inside the drum 23 sequentially passes through multiple holes of the back part 55*b*, the exchange filter 55*c* and the exhaust member.

The laundry treatment apparatus 100 includes an abnormal airflow detection unit 80 disposed on the air channel 40. The abnormal airflow detection unit 80 is disposed on the supply duct 41. For another example, the abnormal airflow detection unit 80 is disposed on the exhaust duct 43. The abnormal airflow detection unit 80 is configured to detect whether an abnormal state of airflow is occurred. The abnormal airflow detection unit 80 is configured to detect whether airflow of air passing through the air channel 40 is abnormal.

Referring to FIG. 3, the differences of a laundry treatment apparatus 100' according to another embodiment from the laundry treatment apparatus 100 will be described below. The laundry treatment apparatus 100' integrally includes a drying function and a washing function.

The laundry treatment apparatus 100' includes a tub 21 in which water is filled. The tub 21 is disposed in the casing 10. The tub 21 may be supported by a supporter mounted on the base and hanged on a hanger. A drum 23 is rotatably disposed in the tub 21. Multiple holes are formed on an outer circumferential surface of the drum 23, and thus water inside the tub 21 can be flowed into the drum 23. The front side of the tub 21 is open, and thus forms a laundry entrance. A gasket 17 is provided between the laundry entrance of the tub 21 and the laundry entrance of the front cover 11.

The laundry treatment apparatus 100' includes a drum motor 25 which rotates the drum 23 and is disposed at back side of the tub 21. The laundry treatment apparatus 100' includes a fan 51 disposed on a supply duct 41. The laundry treatment apparatus 100' is provided with a fan motor 52 separated from a drum motor 25. A supply member of the supply duct 41 is disposed at the front portion of the tub 21. An exhaust member of an exhaust duct 43 is disposed at back portion of the tub 21.

The laundry treatment apparatus 100' includes a water supply channel 61 by which water from an external water source is guided into the tub 21. A water supply valve 63 is provided on the water supply channel 61. A detergent supply unit 65 for accommodating of detergent is provided on the water supply channel 61. Water flowing along the water supply channel 61 is flowed into the tub 21 through the detergent supply unit 65.

The laundry treatment apparatus 100' includes a drain channel 71 by which water from the tub 21 is guided to be flowed out to the outside of the casing 10. A pump 73 which puts pressure on water is provided on the drain channel 71.

Referring to the arrow As of FIG. 3, external air is supplied into the tub 21 through the supply duct 41. Referring to the arrow Ae1 of FIG. 3, air inside the tub 21 is flowed out to the outside through the exhaust duct 43. Referring to the arrow Ae2 of FIG. 3, air which has flowed through the exhaust duct 43 flows through a system duct 200.

Figure 4:
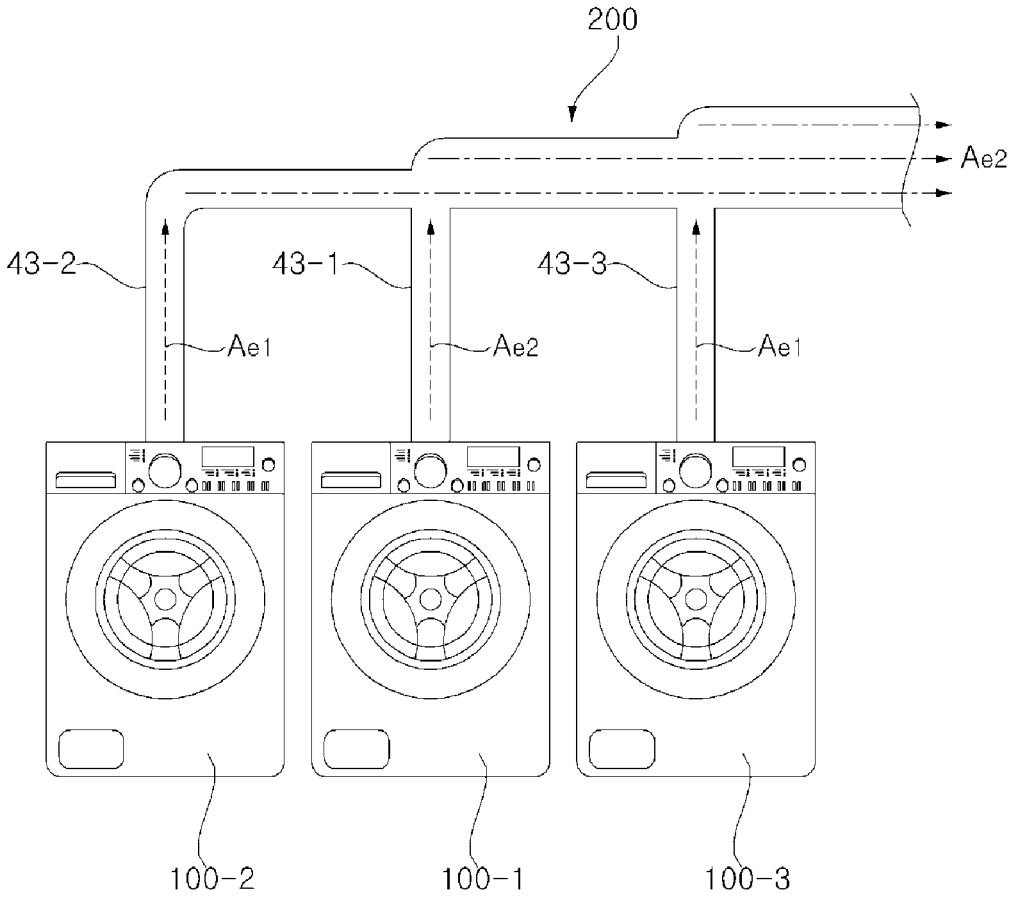
FIG. 4 is a schematic view illustrating multiple laundry treatment apparatuses 100-1, 100-2 and 100-3 and a system duct 200 connected to them according to an embodiment of the disclosure.

Referring to FIG. 4, the system duct 200 is not a component of laundry treatment apparatuses 100, 100, but a part disposed in a using environment of one or more laundry treatment apparatuses. In a using environment according to an embodiment with reference to FIG. 4, a plurality of laundry treatment apparatuses 100-1, 100-2 and 100-3 may share one system duct 200. The plurality of laundry treatment apparatuses 100-1, 100-2 and 100-3 are provided with exhaust ducts 43-1, 43-2 and 43-3 respectively, and the exhaust ducts 43-1, 43-2 and 43-3 are connected to one system duct 200. The air (Ae1) flowed out to outside through each of the exhaust ducts 43-1, 43-2 and 43-3 is flowed into the system duct 200, and flows (Ae2).

Figure 5A:
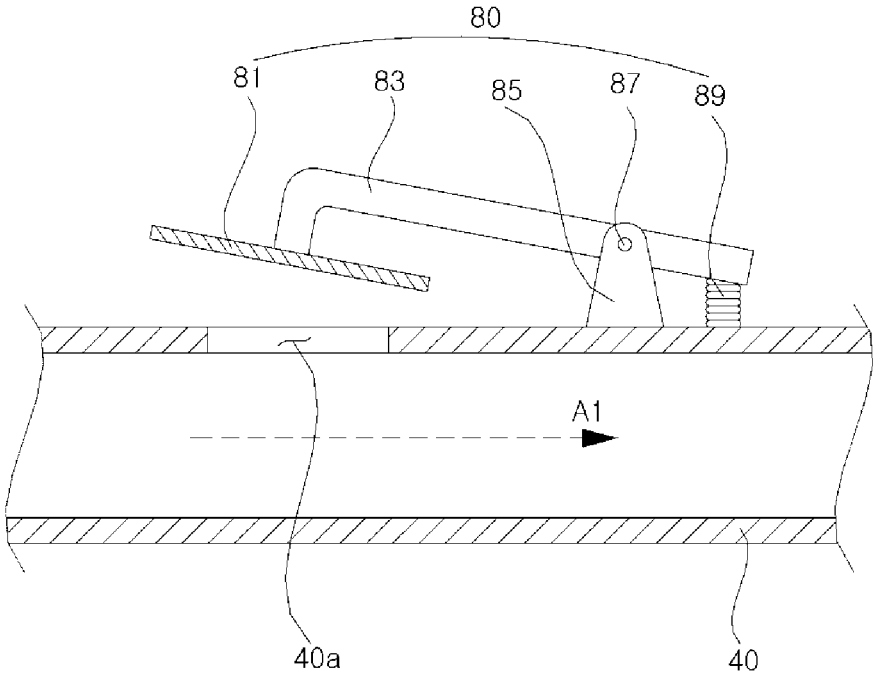
FIGS. 5*a* and 5*b* are sectional views illustrating an abnormal airflow detection unit 80 according to an embodiment of the disclosure.
Figure 5B:
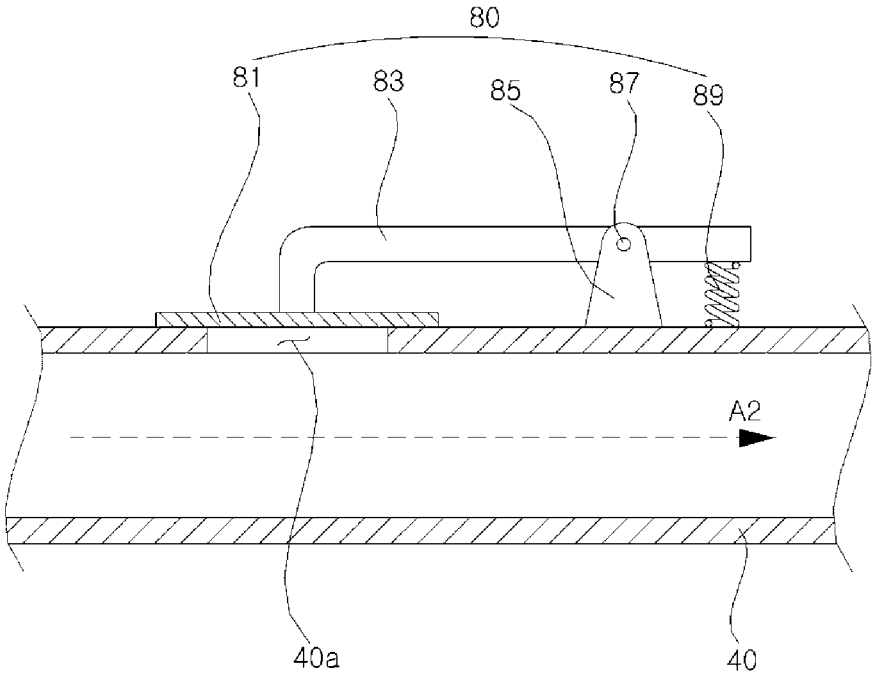

Referring to FIGS. 5*a* and 5*b*, an abnormal airflow detection unit 80 includes an air flow switch 80 which is open or closed according to the airflow (F) inside the air channel 40. The air flow switch 80 may be configured to be open or closed based on a predetermined value (Fa) of airflow.

More specifically, a detection hole 40 is formed on a side surface of the air channel 40. The air flow switch 80 includes a hole cover 81 which is configured to open or close the detection hole 40*a*. The hole cover 81 is formed of a plate-shaped member. The air flow switch 80 includes an arm 83 supporting the hole cover 81. The air flow switch 80 includes a support member 87 which rotatably supports the arm 83. The support member 87 may be mounted on an external surface of the air channel 40, or mounted in another component. The arm 83 is connected to a support member 85 by a rotation axis 87. The arm 83 rotates about the rotation axis 87. The air flow switch 80 includes an elastic member 89 which puts an elastic force by which the arm 83 is rotated in one direction. In accordance with an embodiment, one end of the elastic member 89 is fixed on the opposite side of the hole cover 81 with respect to the rotation axis 85, and thus the arm 83 may be pulled toward the other end of elastic member 89. The elastic member 89 is placed in a manner that the arm 83 can be moved in such a direction that the hole cover 8*l* spaces apart from a detection hole 40*a*. That is, if a negative pressure by the airflow (F) is not generated more than a certain level, the hole cover 81 moves in a direction that it does not cover the detection hole 40*a* by the elastic force of the elastic member 89.

Referring to FIG. 5*a*, if airflow (F) flowing through the air channel 40 is not enough, such as under a certain level, the hole cover 81 is configured to open the detection hole 40*a*. Referring to FIG. 5*b*, if airflow (F) flowing through the air channel 40 is enough, such as over a certain level, the hole cover 81 is configured to close the detection hole 40*a*. Referring to FIG. 5*a*, if the air flow switch 80 is open, in this case, a controller 31 is configured to determine that airflow is in an abnormal state. As in FIG. 5*b*, if the air flow switch 80 is closed, in this case, a controller 31 is configured to determine that airflow is in a normal state. An elastic member 89 may be provided with an appropriate modulus of elasticity in order to preset that an abnormal airflow detection unit 80 causes the detection hole 40*a* to be open if airflow (F) is less than a predetermined level.

Figure 6:
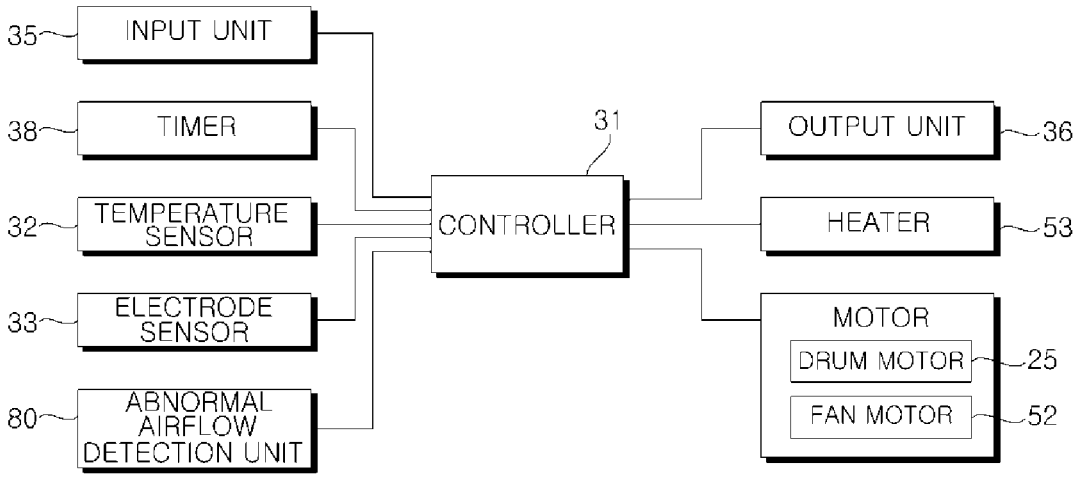
FIG. 6 is a control block diagram illustrating the laundry treatment apparatuses 100 and 100' of FIGS. 1 and 2 according to an embodiment of the disclosure.

Referring to FIG. 6, the laundry treatment apparatuses 100 and 100' include a controller 31 performing a control method. The controller 31 controls each component of the laundry treatment apparatuses 100 and 100'. The controller 31 may process each signal or information input or received from a use or components.

The controller 31 is configured to receive a signal input from input unit 35. The laundry treatment apparatuses 100 and 100' are provided with a timer 38, the controller 31 may perform a processing for the control method by using the timer 38. The laundry treatment apparatuses 100 and 100' may include a temperature sensor 32 detecting the temperature of the laundry in the drum 23 or the air in the air channel 40. The laundry treatment apparatuses 100 and 100' may include a humidity sensor detecting the humidity of the laundry. The controller 31 receives a detected signal from the temperature sensor 32. The humidity sensor may be an electrode sensor 33 which uses a resistance value which varies according to an amount of water included in the laundry of the drum 23. The controller 31 receives a detected signal from the humidity sensor 32. The controller 31 receives a detected signal from the abnormal airflow detection unit 80, and determines whether airflow is in an abnormal state.

The controller 31 controls an operation of an output unit 39. The controller 31 controls an operation of a heater 53. The controller 31 controls an operation of a motor (M). The controller 31 controls an operation of a drum motor 52. The controller 31 controls an operation of a fan motor 52. The controller 31 controls a RPM of the fan motor 52.

Figure 8:
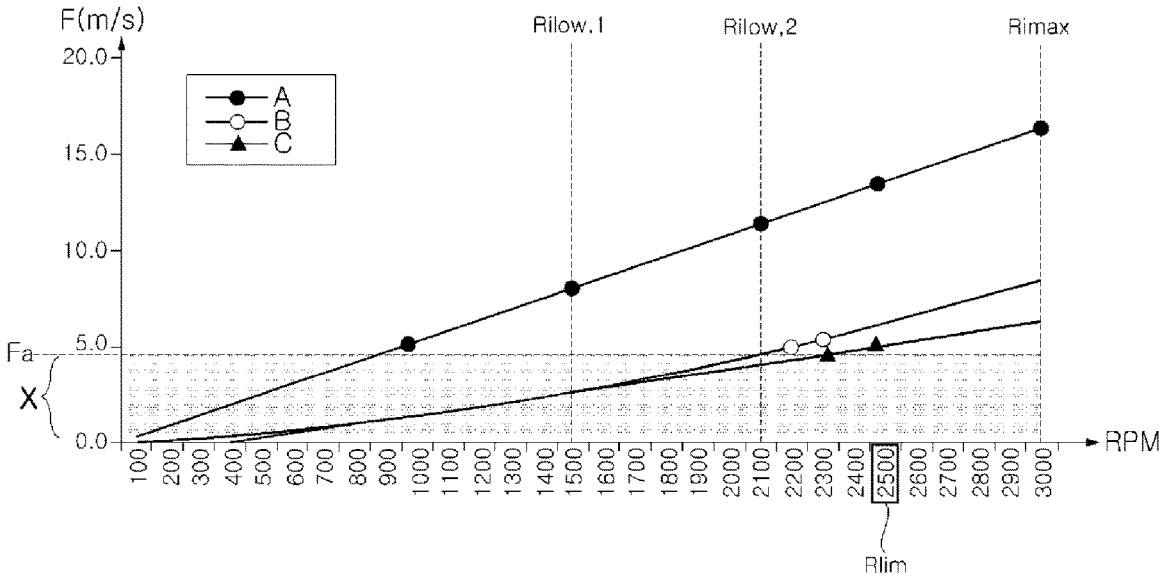
FIG. 8 is a graph illustrating airflow (F) measured from an air channel based on exhaust conditions (A, B and C) and the RPMs of the fan motor 52 according to an embodiment of the disclosure.

Referring to FIGS. 7 to 9, an experimental example is described in order to experimentally find out a relation between an exhaust condition, a RPM of the fan motor 52, airflow (F) and/or a duty value (D) of the fan motor. This experimental example is a result of an experiment performed in a state where the exhaust condition was divided into a higher exhaust condition section (A), a medium exhaust condition section (B) and a lower exhaust condition section (C) in order of decreasing flow resistance. The experimental result shows the fan motor duty value (D) of a laundry treatment apparatus 100-1 and airflow (F) in the exhaust duct 43-1 which are measured by varying the RPM and the exhaust condition of the fan motor 52 of the laundry treatment apparatus 100-1 of a plurality of laundry treatment apparatuses 100-1, 100-2 and 100-3 of FIG. 4. The higher exhaust condition section (A) refers to a state where the fan motors of other laundry treatment apparatuses 100-2 and 100-3 except for the laundry treatment apparatus 100-1 with which the experiment has been performed are stopped. The medium exhaust condition section (B) refers to a state where the fan motor of one laundry treatment apparatus 100-2 of the other laundry treatment apparatuses 100-2 and 100-3 is operated at a predetermined RPM, and the fan motor of the other laundry treatment apparatus 100-3 is stopped. The lower exhaust condition section (C) refers to a state where all fan motors of other laundry treatment apparatuses 100-2 and 100-3 are operated at a predetermined RPM. FIGS. 7 and 8 illustrate, as an example, a first low-level base RPM ($R_{ilow,1}$), a second low-level base RPM ($R_{ilow,2}$)) and a maximum base RPM ($R_{imax}$)).

In FIG. 7, the exhaust conditions A, B and C are shown in each time section, and timings (ra, rb, rc and rd) in which the command RPMs (R(t)) has been increased are shown. As a result, a RPM and a fan motor duty value (D) actually observed are shown in the graph, and sections (X) in which it is determined that airflow is in an abnormal state are shown.

FIG. 8 shows that the experimental results of this experimental example are summarized on the orthogonal coordinates with the x-axis as the RPM and the y-axis as the airflow (F). FIG. 7 shows a base airflow value (Fa). Airflow (F) less than or equals to the base airflow value (Fa) corresponds to sections (X) in which it is determined that airflow is in an abnormal state. Graphs according to each of exhaust conditions (A, B and C) are shown. According to the experimental results of FIG. 8, the better the exhaust condition, the smaller the RPM at which it is determined that airflow is in a normal state is relatively.

FIG. 9 shows that the experimental results of this experimental example are summarized on the orthogonal coordinates with the x-axis as the RPM and the y-axis as the fan motor duty value (D). Graphs according to each of exhaust conditions (A, B and C) are shown. According to the experimental results of FIG. 9, the better the exhaust condition is, the larger the fan motor duty value (D) is measured.

The conclusions that can be found through this experiment as shown in FIGS. 7 to 9 are as follows. Referring to FIGS. 7 and 9, under a condition that the RPM is constant, the better the exhaust condition is (the smaller the flow resistance is), the larger the fan motor duty value (D) tends. Moreover, under a condition that the RPM is constant, the larger the RPM is, the larger the fan motor duty value (D) tends. Referring to FIG. 8, under a condition that the RPM is constant, the better the exhaust condition is, the larger the airflow (F) tends. Moreover, under a condition that the exhaust condition is constant, the larger the RPM is, the larger the airflow (F) tends. Referring to FIGS. 7 to 9, under a condition that the RPM is constant, the larger the airflow (F) is, the larger the fan motor duty value (D) tends. This is with the result that the larger the airflow (F) is, the larger the power is.

As another experimental example, even if an experiment is performed in a case where the exhaust condition is divided into more numbers, or the exhaust condition is divided in a state where the size of the obstacle in the air channel 40 is varied, the relation between the exhaust condition, the RPM of the fan motor 52, airflow (F) and/or the fan motor duty value (D) is observed to be substantially the same.

Hereinafter, referring to FIGS. 10*a* to 18*d*, a control method according to an embodiment of the laundry treatment apparatus will be described.

The control method includes a dry start step S200 starting the drying operation by rotating the fan motor 52 at a predetermined base RPM ($R_i$). A drying process of the laundry treatment apparatus is stated in the dry start step S200. In the dry start step S200, the fan motor 52 may rotate at a predetermined base RPM ($R_i$). In the dry start step S200, air heated by the heater 53 may be supplied into the drum 23 by the pressure generated by the fan motor 52. In the dry start step S200, if the fan motor 52 is operated, air in the drum 23 is caused to flow out through the exhaust duct 43.

The control method includes a RPM control step S300 varying the RPM of the fan motor 52 after the dry start step S2 is started. In the RPM control step S300, if it is determined that airflow is in an abnormal state during rotating of the fan motor 52, the RPM of the fan motor 52 is increased. In a state where the RPM of the fan motor 52 is increased due to the abnormal airflow, if a predetermined condition for recovering is satisfied, the RPM of the fan motor 52 may be decreased.

The control method includes a laundry amount detection step S100 detecting the weight of the laundry in the drum 23. The laundry amount detection step S100 may be performed before the dry start step S200, or during the dry start step S200. Without the laundry amount detection step S100, a level of an amount of the laundry may be directly input through the input unit 35 by a user.

The control method includes a base RPM selection step S150 selecting one of a plurality of base RPMs ($R_i$) according to an amount of the laundry detected or input. The base RPM selection step S150 may be performed before the dry start step S200, or during the dry start step S200. The base RPM ($R_i$) can be directly selected by a user and thus be input through the input unit 35.

The control method includes an error-responsive-operation step S400 performing an operation responsive to an error if it is determined that airflow is in the abnormal state during rotating of the fan motor 52 under a predetermined condition after the dry start step S200 is started. Whether the error-responsive-operation step S400 is performed may be determined according to an amount of the laundry. Whether the error-responsive-operation step S400 is performed may be determined according to a selected base RPM ($R_i$). Whether the error-responsive-operation step S400 is performed may be determined according to a base RPM ($R_i$) selected according to an amount of the laundry. Whether the error-responsive-operation step S400 is performed may be determined according to whether a predetermined condition (a critical condition) is satisfied after the RPM control step S300 is started.

The operation responsive to the error may include an operation of stopping the fan motor 52 such as adjusting of the RPM of the fan motor 52 to zero. The operation responsive to the error may include an operation of turning off the heater 53. The operation responsive to the error may include an operation of stopping the rotation of the drum 23. The operation responsive to the error may include an operation of visually or audibly outputting an error information through the output unit 36. The operation responsive to the error may include an operation of transmitting an error information to a user's mobile handset or a server for service through a communication unit included the laundry treatment apparatus.

The control method includes a dry end step S500 stopping the drying of the laundry. The dry end step S500 is proceeded after the RPM control step S300 or the error-responsive operation step S400 is started. The dry end step S500 may be preset to determine whether a predetermined end condition is satisfied S510, and end the drying operation if the predetermined end condition is satisfied. For example, the end condition may include a first condition in which the drying operation is performed during a predetermined time. The end condition may include a second condition in which the error-responsive-operation step S400 is started. The end condition may be such a condition that one of the first and second conditions is satisfied.

Figure 11:
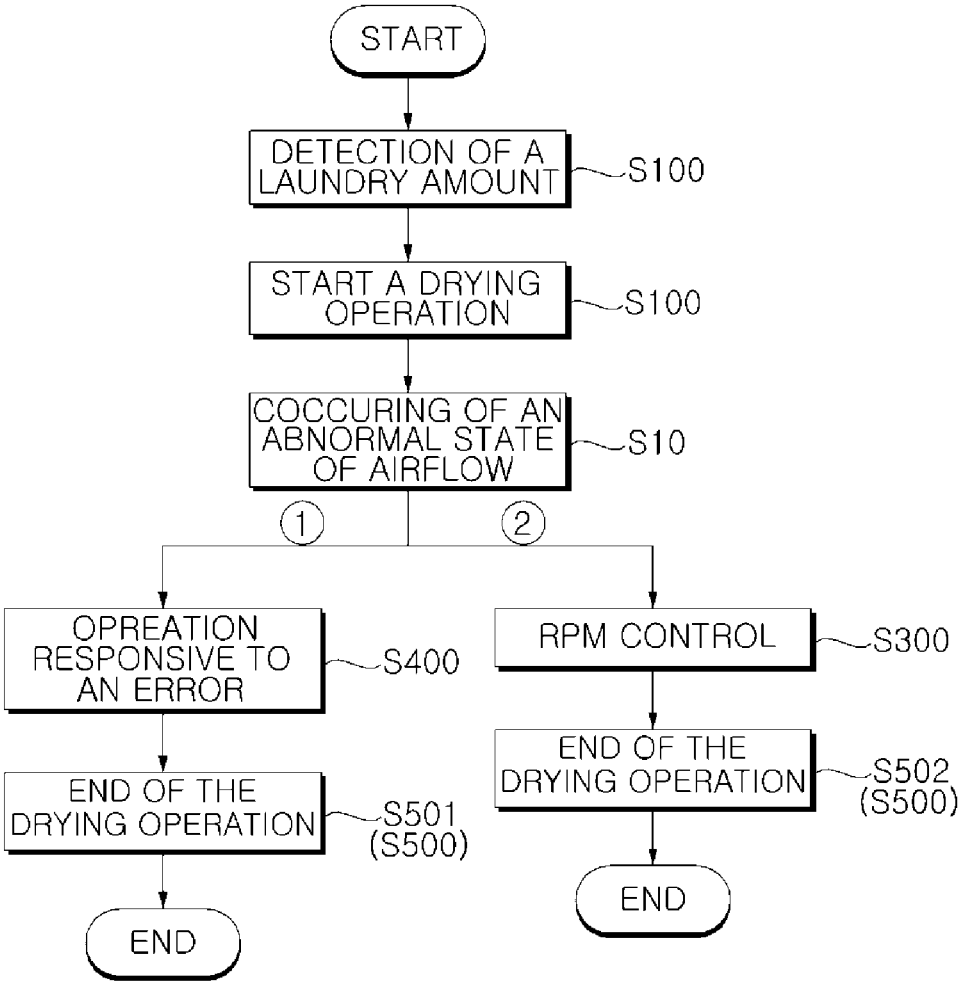
FIG. 11 is a flow chart illustrating control scenarios (①, ②) according to an embodiment of the disclosure.

FIGS. 10*a* and 10*b* are graphs showing the RPM of the fan motor 52 which is controlled at the same time as the graph of airflow (F) which varies with time, and show some scenarios (①, ②) in which the RPM of the fan motor 52 is varied if an abnormal state of airflow is occurred in which airflow (F) is decreased less than or equals to a predetermined value. FIG. 11 is a flow chart illustrating control scenarios (①, ②) in a case where an abnormal state of airflow is occurred S10 according to an embodiment of the laundry treatment apparatus. FIG. 11 shows a scenario in which an operation responsive to the error is performed in a case where an abnormal state of airflow is occurred S10, and another scenario in which the RPM of the fan motor 52 is increased in a case where an abnormal state of airflow is occurred S10, and thereafter it is decreased if a recovering condition is satisfied. FIG. 10*a* illustrates a first scenario (①) in which the fan motor 52 is stopped as an operation responsive to the error in a case where an abnormal state of airflow is occurred. FIG. 10*b* illustrates a second scenario (②) of increasing and recovering of the RPM of the fan motor 52 according to the RPM control step S300 in a case where an abnormal state of airflow is occurred.

In the first scenario (①), in a case where the abnormal state of airflow is occurred, the heater 53 and the fan motor 52 are turned off, and as a result of this, overheating of the heater 53 and wasting of power can be prevented. Moreover, in the first scenario (①), an error information is informed to a user or the like, and thus an appropriate responsive measure can be quickly taken by the user or the like.

In the second scenario (②), in a case where the abnormal state of airflow is occurred, the airflow (F) is induced to be increased by increasing the RPM of the fan motor 52. Because of this, overheating of the heater 53 can be prevented and a normal drying process can be performed. Moreover, in the second scenario (②), if a predetermined condition (recovering condition) is satisfied after the RPM has been increased, by decreasing the RPM, wasting of power can be prevented and appropriate airflow (F) according to an amount of the laundry is provided. The recovering condition is such an estimated condition that an abnormal state of airflow will not be any more occurred even if the RPM is decreased. In this embodiment, whether a recovering condition is satisfied is determined based on a change of a duty value (D) of the fan motor after the RPM has increased.

Referring to FIGS. 10*a*, 10*b* and 11, in accordance with an embodiment of the control method, only the second scenario which proceeds with the RPM control step S300 can be performed, or any one of the first and second scenarios can be selectively performed according to a predetermined standard.

The first and second scenarios of FIG. 11 will be described in detail below. In accordance with the control method, a laundry amount detection step S100 and a dry start step S200 are performed. Thereafter, an abnormal state of airflow is occurred S10 by occurrence of obstacles in the air channel 40, accumulating of lint in the filter 55, performing of an exhaust process of other laundry treatment apparatuses 100-2 and 100-3 which share a system duct 200, or the like. In this case, it is determined that airflow is in an abnormal state by the abnormal airflow detection unit 80. In a case where the dry start step S200 is proceeded at the maximum base RPM ($R_{imax}$), if it is determined that airflow is in an abnormal state, an error-responsive-operation step S400 is performed according to the first scenario (①). After the error-responsive-operation step S400 is started, a dry end step S501 may be performed. In a case where the dry start step S200 is proceeded at a low-level base RPM ($R_{ilow}$), if it is determined that airflow is in an abnormal state, a RPM control step S300 is performed according to the second scenario (②). After the RPM control step S300 is started, a dry end step S502 may be performed.

Figure 12:
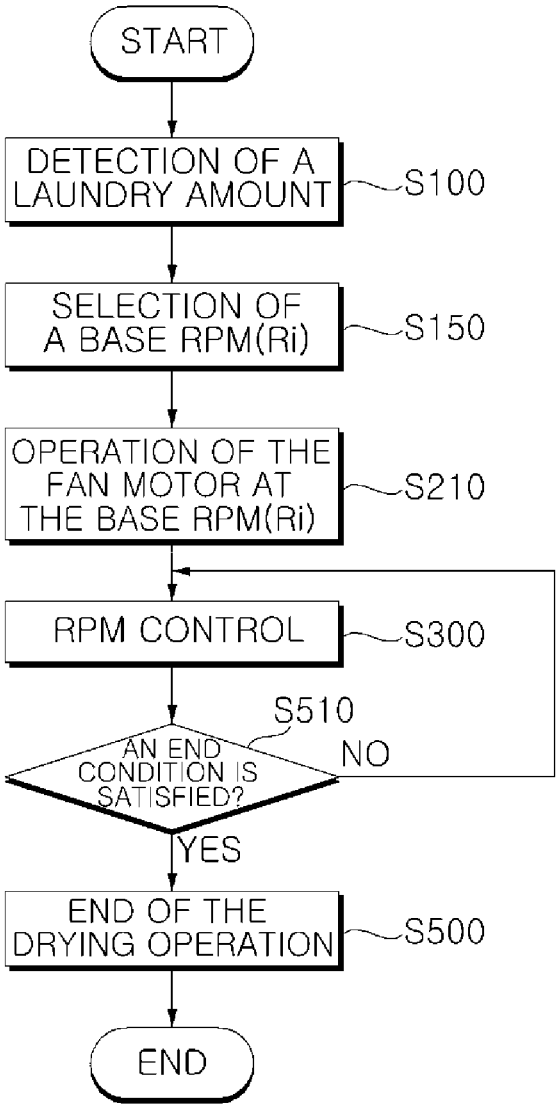
FIG. 12 is a flow chart illustrating a control method of the laundry treatment apparatus according to an embodiment of the disclosure.

FIG. 12 illustrates an embodiment according to the first scenario (①) of the control method. Referring to FIG. 12, the control method includes a laundry amount detection step S100. In accordance with this embodiment, after a laundry amount detection step S100 is started, a base RPM selection step S150 and a dry start step S200 are sequentially performed. As another embodiment, the base RPM selection step S150 and the dry start step S200 can be substantially concurrently performed, or the base RPM selection step can be included into the dry start step S300. Thereafter, the fan motor 52 is operated at a selected base RPM ($R_i$) S210. The fan motor 52 can be operated at a base RPM ($R_i$) and the drying process of the laundry treatment apparatus can be started. The step 210 may be included into the dry start step S200. After the step 210 is started, a RPM control step S300 is performed. In the RPM control step S300, if it is determined that airflow is in an abnormal state, a RPM may be increased. In the RPM control step S300, if it is determined that airflow is in an abnormal state, the base RPM ($R_i$) may be maintained and the drying process may be performed. In a state where the RPM has been increased during the RPM control step S300, if a recovering condition is satisfied, the RPM may be decreased. In a state where the RPM has been increased during the RPM control step S300, if a recovering condition is not satisfied, a command RPM (R(t)) may be steadily increased. The control method includes a step for determining whether an end condition is satisfied. The step S10 may be performed during proceeding of the RPM control step S300. If the end condition is satisfied, a dry end step S500 is performed.

Referring to FIGS. 13 to 18*d*, each step of the control method according to an embodiment of the laundry treatment apparatus will be described.

Figure 13:
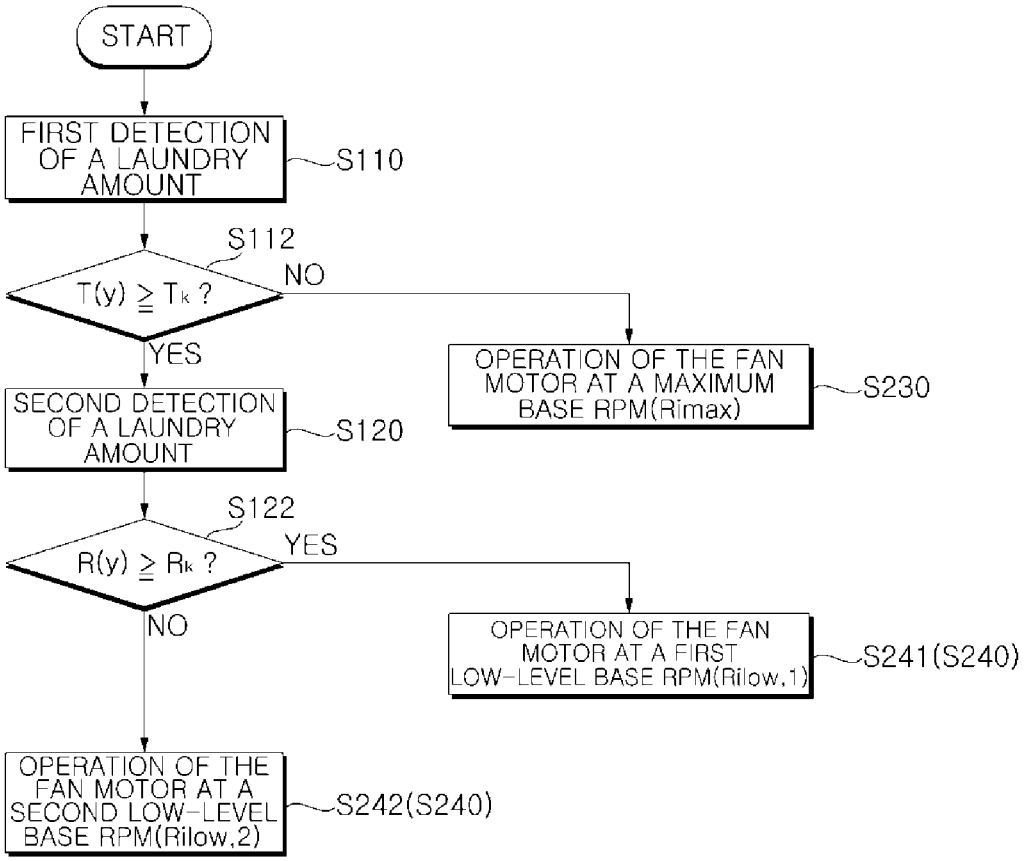
FIG. 13 is a flow chart illustrating detection on an amount of the laundry and a procedure for starting of the drying of laundry (S100, S200) in FIG. 12 according to an embodiment of the disclosure.

Referring to FIG. 13, in a laundry amount detection step S100, an amount of the laundry is detected, and a level of the laundry is determined.

The laundry amount detection step S100 may be performed by using a temperature sensor. The amount of the laundry is determined based on an increasing level of the temperature of the laundry per hour by supplying heated wind to the laundry. This is to use a principle that the more the weight of laundry and/or water content is, the lower the rate of temperature increase with reference to the same supply calorie is.

The laundry amount detection step S100 may be performed by a humidity sensor. The higher the measured humidity is, the more an amount of the laundry can be relatively determined. A level of humidity may be detected by using an electrode sensor 33. The electrode sensor 33 is provided with both poles which are positioned in a manner that the pores are exposed toward the inside of the drum 23. The both poles are electrically connected to each other through the laundry, and thus a resistance value of the laundry can be measured. This is to use a principle that the more water is, the smaller the resistance value is.

A level of the amount of the laundry may be divided into a plurality of levels. In this preferred embodiment, the level may be, not limited to, divided into three levels such as, a large, small and thimbleful levels, but it is also possible to divide into a larger number of levels. Moreover, the level may be divided into two levels, a small level and a large level.

The laundry amount detection step S100 may include a first laundry amount detection step S110 and a second laundry amount detection step S120. In the first laundry amount detection step S110, the level may be divided into a large level and a small level, and if it is determined that the amount of the laundry is small, the second laundry amount detection step S120 is proceeded and the level may be divided into a small and thimbleful levels. As an another embodiment, it is possible to control that the amount of the laundry may be divided into more than three levels by comparing a value obtained from an one-time detection of the laundry with a plurality of reference values.

It is possible that the amount of the laundry may be divided into more than three levels by using all of the temperature sensor 32 and the humidity sensor 33. Moreover, it is possible that the amount of the laundry may be divided into more than three levels by using each of the temperature sensor 32 and the humidity sensor 33.

In this preferred embodiment, the laundry amount detection step S100 is performed by using all of the temperature sensor 32 and the humidity sensor 33. In the first laundry amount detection step S110, the temperature sensor 32 may be used. In the second laundry amount detection step S120, the humidity sensor 33 may be used.

In this preferred embodiment, after the first laundry amount detection step S110 is started, a procedure for comparing a temperature increase value (T(y)) obtained from the temperature sensor 32 with a predetermined value (Tk) S112. In a state where heated wind is supplied to the laundry for a predetermined time, if the temperature increase value (T(y)) of the laundry is more than or equals to a predetermined value (Tk), the amount of the laundry may be determined to a relatively small level, and if the temperature increase value (T(y)) of the laundry is less than a predetermined value (Tk), the amount of the laundry may be determined to the highest level. If the amount of the laundry is determined to the highest level, the fan motor 52 is operated at a maximum base RPM ($R_{imax}$)) S230. If the amount of the laundry is determined to the relatively small level, the fan motor 52 is operated at a low-level base RPM ($R_{ilow}$) S240. As another embodiment, the amount of the laundry may be divided into more than three levels by comparing the temperature increase value (T(y)) with a predetermined value (Tk).

In this preferred embodiment, if the amount of the laundry is determined to the relatively small level through the step S112, a second laundry amount detection step S120 is performed. After the second laundry amount detection step S120 is started, a step for comparing an electric resistance value (R(y)) obtained by the electrode sensor 33 with a predetermined value (Rk) is performed S122. If the electric resistance value (R(y)) is more than or equals to the predetermined value (Rk), the amount of the laundry is determined to a relatively low level, a thimbleful amount, and if the electric resistance value (R(y)) is less than the predetermined value (Rk), the amount of the laundry is determined to a relatively high level, a small amount. If the amount of the laundry is determined to a lowest level, the fan motor 52 is operated at a first low-level base RPM ($R_{ilow,1}$) S241. If the amount of the laundry is determined to a higher level by one step more than the lowest level, the fan motor 52 is operated at a second low-level base RPM ($R_{ilow,2}$) S242. As another embodiment, the amount of the laundry may be divided into a larger number more than the above embodiment by comparing the electric resistance value (R(y)) with a predetermined value (Rk). If the level of the amount of the laundry is n number of levels, a first low-level base RPM ($R_{ilow,1}$) to an n low-level base RPM ($R_{ilow,n}$) and a maximum base RPM may be preset, which correspond to each level of the amount of the laundry. Wherein n is a natural number.

Referring to FIG. 13, a base RPM ($R_i$)) is preset to a plurality of base RPMs ($R_i$). A plurality of base RPMs ($R_i$)) may be preset, which correspond to a plurality of levels of the amount of the laundry. In a case where the amount of the laundry is a highest level, a maximum base RPM ($R_{imax}$) is selected, and in a case where the amount of the laundry is a lower level by one level than the highest level, a low-level base RPM ($R_{ilow}$) is selected. In a case where the amount of the laundry is a lowest level, a first low-level base RPM ($R_{ilow,1}$) is selected, and in a case where the amount of the laundry is a higher level by one level than the lowest level, a second low-level base RPM ($R_{ilow,2}$) is selected. In a case where the amount of the laundry is a higher level by n−1 level than the lowest level and lower that the highest level, a n low-level base RPM ($R_{ilow,n}$) is selected. Wherein n is a natural more than or equals to 2.

In a dry start step S200, the fan motor 52 may rotate at a base RPM ($R_i$) selected according to a predetermined standard, and start the drying operation. The fan motor 52 may rotate at a base RPM ($R_i$) varying according to an amount of the laundry, and start the drying operation (S230, S240).

The plurality of base RPMs ($R_i$) may includes a maximum base RPM ($R_{imax}$) selected in a case where the amount of the laundry is relatively large, and a low-level base RPM ($R_{ilow}$) selected in a case where the amount of the laundry is relatively small. A low-level base RPM ($R_{ilow}$) may include a first low-level base RPM ($R_{ilow,1}$) to an n low-level base RPM ($R_{ilow,n}$). Wherein n is a natural more than or equals to 2.

The plurality of base RPMs ($R_i$) may includes a maximum base RPM ($R_{imax}$) selected in a case where the amount of the laundry is relatively large, and a first low-level base RPM ($R_{ilow,1}$) selected in a case where the amount of the laundry is relatively small, and a second low-level base RPM ($R_{ilow,2}$) selected in a case where the amount of the laundry is lower than the maximum base RPM ($R_{imax}$) and higher than the first low-level base RPM ($R_{ilow,1}$)). The plurality of base RPMs ($R_i$) may includes a third low-level base RPM ($R_{ilow,3}$)) to an n low-level base RPM ($R_{ilow,n}$)) which are lower than the maximum base RPM ($R_{imax}$) and higher than the second low-level base RPM ($R_{ilow,2}$)). Wherein n is a natural more than or equals to 4.

The fan motor 52 may be operated at a maximum base RPM ($R_{imax}$) according to an amount of the laundry or a user's selection S230. The fan motor 52 may be operated at a low-level base RPM ($R_{ilow}$) according to an amount of the laundry or a user's selection S240. The maximum base RPM ($R_{imax}$) is larger that the low-level base RPM ($R_{ilow}$). Moreover, a plurality of low-level base RPMs ($R_{ilow}$) may be preset. FIG. 13 illustrates a procedure S240 in which the fan motor 52 is operated at an n low-level base RPM. More specifically, In FIG. 13, a procedure S241 in which the fan motor 52 is operated at a first low-level base RPM, and a procedure S242 in which the fan motor 52 is operated at a second low-level base RPM are illustrated.

Figure 14:
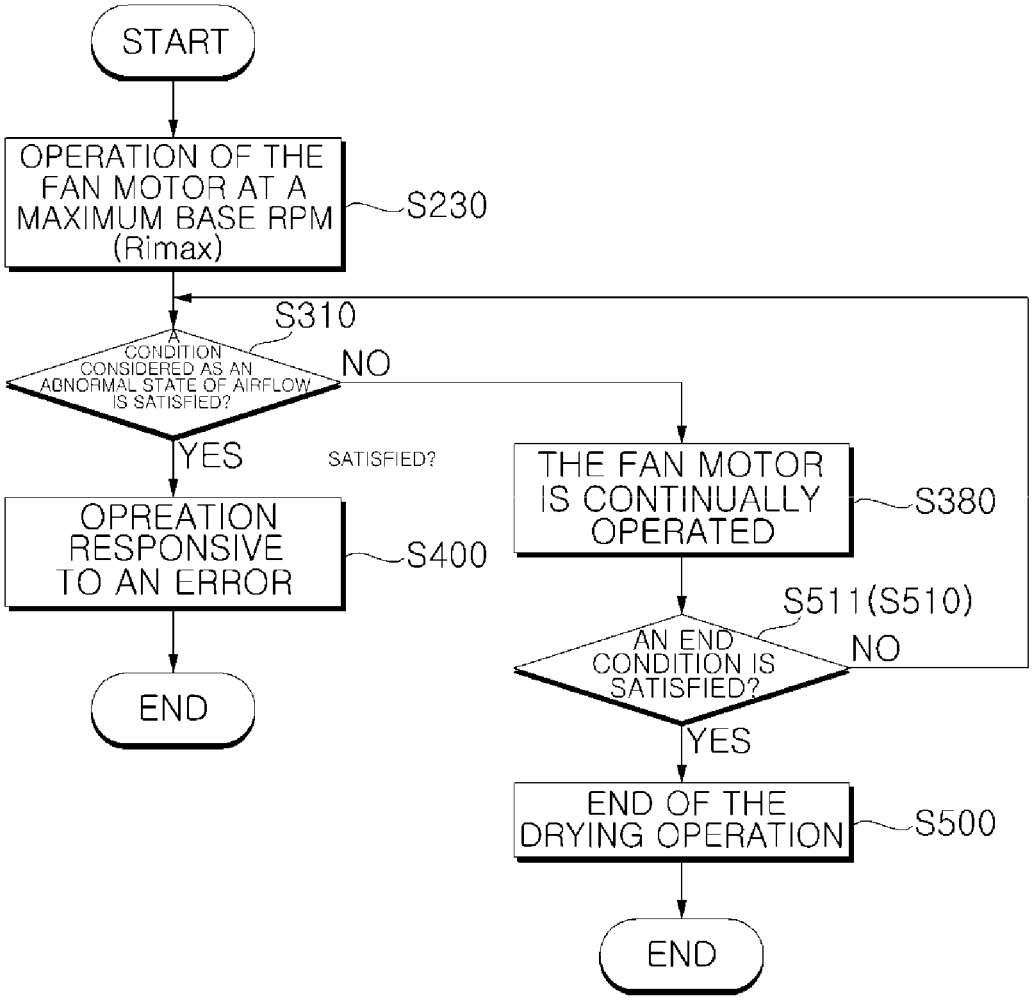
FIG. 14 is a flow chart illustrating a procedure performed in a case where the fan motor 52 is operated at a maximum base RPM ($R_{imax}$)) selected in FIG. 13 according to an embodiment of the disclosure.
Figure 15:
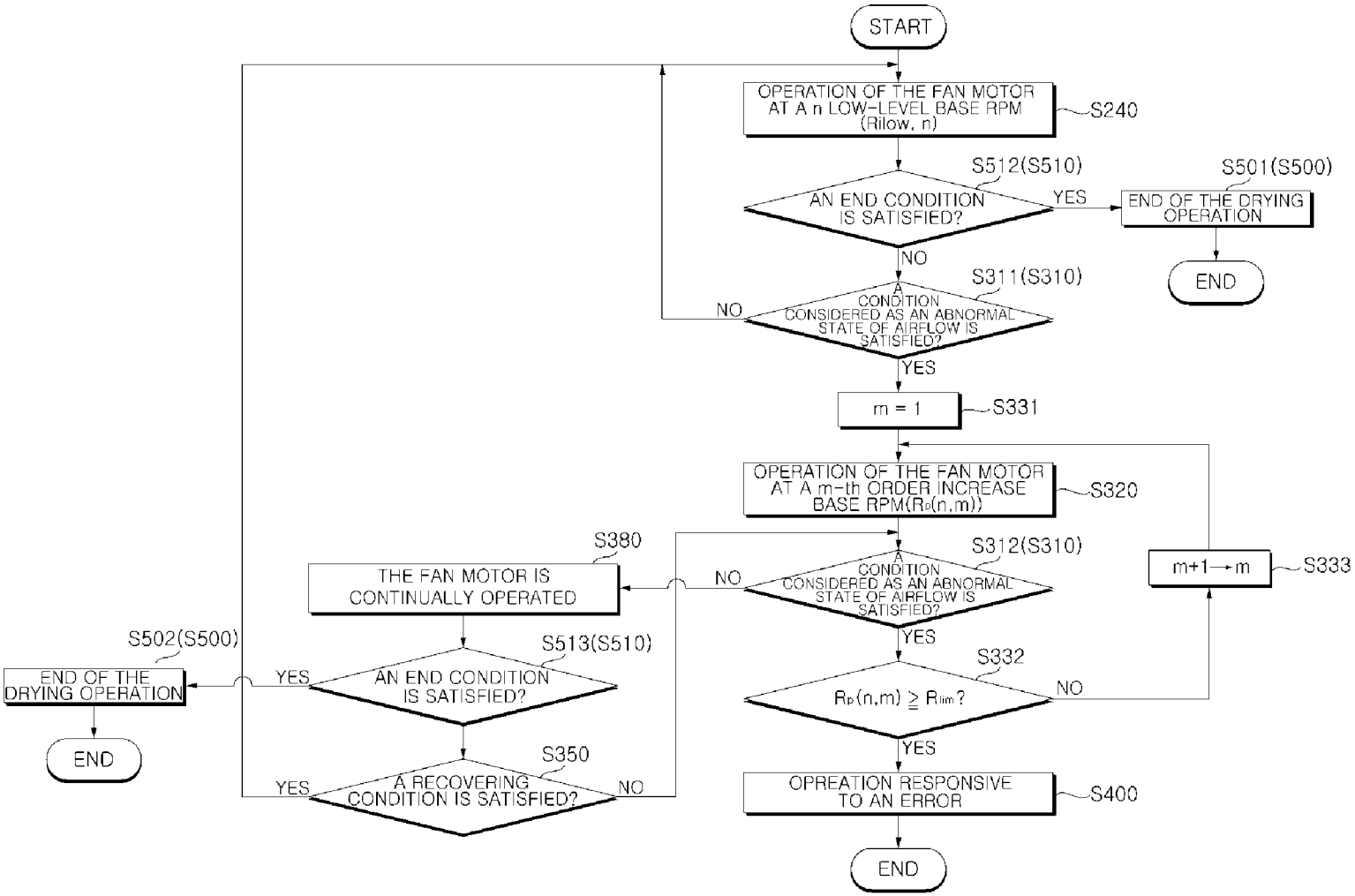
FIG. 15 is a flow chart illustrating a procedure for controlling a RPM S300 of FIG. 15 according to an embodiment of the disclosure.

Referring to FIGS. 11, 14 and 15, in a case where a maximum base RPM ($R_{imax}$)) is selected, if it is determined that airflow is in the abnormal state after a dry start step S200 is started, an operation responsive to the error is performed S400. In a case where a low-level base RPM ($R_{ilow}$) is selected, a RPM control step 300 is performed after the dry start step S200 is started.

Referring to FIG. 14, after operating of the fan motor 52 at the maximum base RPM ($R_{imax}$) has proceeded, a procedure for determining whether a condition considered as an abnormal state of airflow is satisfied is performed S310.

In the step S310, if the condition considered as the abnormal state of airflow is not satisfied, that is the airflow is in a normal state, the fan motor 52 is continually operated S380. Thereafter, whether the condition considered as the abnormal state of airflow is satisfied is continually determined S310. Along with proceeding of this process, whether an end condition is satisfied is determined S511. If the end condition is satisfied, a dry end step S500 is performed.

In the step S310, if the condition considered as the abnormal state of airflow is satisfied, an error-responsive-operation step S400 is performed. Thereafter, a dry end step may be performed.

Referring to FIG. 15, after operating of the fan motor 52 has been proceeded at an n low-level base RPM ($R_{ilow,n}$) a RPM control step S300 is proceeded. The RPM control step S300 includes a procedure for determining whether a condition considered as an abnormal state of airflow is satisfied is performed S310. After operating of the fan motor 52 at the n low-level base RPM ($R_{ilow,n}$) has proceeded, whether the condition considered as the abnormal state of airflow is satisfied is performed S311. One of conditions considered as an abnormal state of airflow is a case that the airflow (F) in the air channel 40 is less that or equals to a predetermined value (Fa), this condition is preset. A condition considered as the abnormal state of airflow may include a case that the air flow switch 80 is open.

Figure 17:
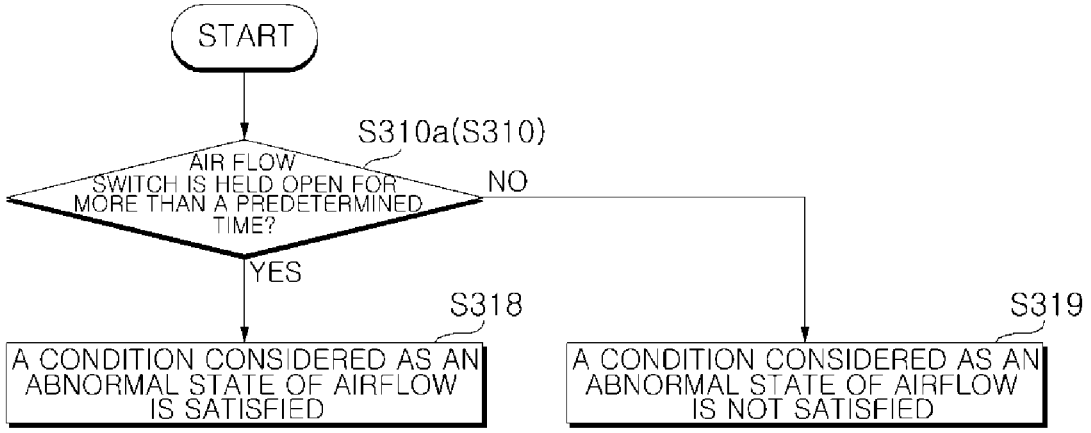
FIG. 17 is a flow chart illustrating a step S310 for determining whether a condition considered as an abnormal state of airflow in FIGS. 14 and 15 is satisfied according to an embodiment of the disclosure.

Referring to FIG. 17, a condition considered as an abnormal state of airflow may include a case that the abnormal airflow state is maintained more than a predetermined time S310*a*. More specifically, satisfying of the abnormal airflow state may be determined by whether the air flow switch 80 is continually open more than a predetermined time. In a case where the air flow switch 80 is continually open more than a predetermined time, it is determined that the condition for satisfying the abnormal airflow state is satisfied 318. A case in which the air flow switch 80 is not continually open more than a predetermined time includes that the air flow switch 80 is continually closed more than a predetermined time. In a case where the air flow switch 80 is not continually open more than a predetermined time, it is determined that the condition for satisfying the abnormal airflow state is not satisfied S319.

Referring back to FIG. 15, in the step S311, if it is not determined that airflow is in the abnormal state, that is the airflow is in the normal state, the fan motor 52 is continually operated S240. Thereafter, whether the condition considered as the abnormal state of airflow is satisfied is continually determined S311. Along with proceeding of this process, whether an end condition is satisfied is determined S512. If the end condition is satisfied, a dry end step S501 is performed.

In the step S311, if it is determined that airflow is in the abnormal state, the RPM of the fan motor 52 is increased in a stepwise manner until it is determined that airflow is in a normal state. In the RPM control step S300, if it is determined that airflow is in an abnormal state only in a case where the RPM of the fan motor 52 does not satisfy a predetermined critical condition, the RPM of the fan motor 52 is increased. In the RPM control step S300, if it is determined that airflow is in the abnormal state only in a case where the RPM of the fan motor 52 is less than a predetermined critical RPM, the RPM of fan motor 52 is increased.

In the step S311, if it is determined that airflow is in the abnormal state, the RPM of fan motor 52 is increased S320. In a case where the RPM of fan motor 52 is an increase RPM ($R_n$), a procedure for determining again whether a condition considered as an abnormal state of airflow is performed S312. In the step S312, if it is determined that airflow is in an abnormal state, the RPM of fan motor 52 is increased to a predetermined m+1 order increase RPM ($R_{p(n,m+1)}$) more than the current m-th order increase RPM ($R_{p(n,m)}$S333, S320. Wherein, m is a natural number. Moreover, in the step S312, if it is determined that the airflow is in a normal state, a procedure for determining whether a recovering condition is satisfied is performed S350.

In the step S311, if it is determined that airflow is in an abnormal state, the RPM of fan motor 52 is increased to a first increase RPM ($R_{p(n,1)}$) S331, S320. In a state where the RPM of fan motor 52 is the first predetermined increase RPM ($R_{p(n,1)}$), if it is determined that airflow is in an abnormal state S312, the RPM of fan motor 52 is increased to a second increase RPM ($R_{p(n,2)}$) more than the first increase RPM ($R_{p(n,1)}$) S333, S320. In a state where the RPM of fan motor 52 is an m-th order increase RPM ($R_{p(n,m)}$), if it is determined that airflow is in an abnormal state S312, the RPM of fan motor 52 is increased to an m+1 order increase RPM ($R_{p(n,m+1)}$) more than an m-th order increase RPM ($R_{p(n,m)}$) S333, S320. Wherein, m is a natural number.

In the step S312, if it is determined that airflow is in the abnormal state, a procedure for determining whether a critical condition is satisfied is performed S332. The critical condition includes a condition in which the RPM of fan motor 52 is more than or equals to a predetermined critical RPM ($R_{lim}$). In a state where the RPM of fan motor 52 is more than or equals to the predetermined critical RPM ($R_{lim}$), if it is determined that airflow is in an abnormal state, an operation responsive to the air is performed S340. More specifically, in the step S310, if it is determined that airflow is in an abnormal state, and in the step S322, if it is determined that the critical condition is satisfied, an error-responsive-operation step S400 is performed.

In a state where the RPM of the fan motor 52 is less than or equals to a predetermined critical RPM ($R_{lim}$), and the RPM of fan motor 52 is a predetermined m-th order increase RPM ($R_{p(n,m)}$), if it is determined that airflow is in an abnormal state S312, S332, the RPM of fan motor 52 is increased to a m+1 order increase RPM ($R_{p(n,m+1)}$)) S333, S320. Wherein, m is an arbitrary natural number.

In the step S312, if it is determined that the airflow is in a normal state, a procedure for determining whether a recovering condition is satisfied S350 is performed. In this preferred embodiment, in a case where the fan motor 52 is rotating at an m-th order increase RPM ($R_{p(n,m)}$), if it is determined that the airflow is in a normal state in the step S312, a procedure may be performed in which the current m-th order increase RPM ($R_{p(n,m)}$) is maintained and operating of the fan motor 52 is continually operated S380. Along with proceeding of this process, whether an end condition is satisfied is determined S513. If the end condition is satisfied, a dry end step S502 is performed. Moreover, along with proceeding of this process, a procedure for determining whether a recovering condition is satisfied is performed S350.

In the step S350, if it is determined that the recovering condition is not satisfied, the current m-th order increase RPM ($R_{p(n,m)}$) is maintained and operating of the fan motor 52 is continually operated S380. Along with proceeding of this process, procedures for determining whether a condition considered as the abnormal state of airflow is satisfied S312 and whether the end condition is satisfied S513 are performed.

In the step S312, in a state where the airflow is recovered into a normal state, it is preset to determine whether a recovering condition is satisfied S350. In the step S350, if it is determined that the recovery condition is satisfied, the RPM of fan motor 52 is decreased. While the fan motor 52 is rotating in a state where the RPM of fan motor 52 is increased more than a base RPM ($R_i$), if it is determined that a recovering condition is satisfied S350, the RPM of fan motor 52 is decreased. In this preferred embodiment, if it is determined that a recovering condition is satisfied, the RPM of the fan motor 52 is decreased to the base RPM ($R_i$) in the RPM dry start step S240. More specifically, in a case where the fan motor 52 is caused to be operated at a n low-level base RPM ($R_{ilow,n}$) and has performed the dry start step S200, if it is determined that the recovering condition is satisfied in the step S350, the RPM of the fan motor 52 is decreased to then low-level base RPM S240. No limitation to this is imposed, and the RPM of fan motor 52 is decreased to a RPM which is more than the base RPM ($R_i$) and less than the current RPM. After the step 240 has been proceeded in which the fan motor 52 is operated in a state where the RPM of the fan motor 52 has been decreased, procedures for determining whether the end condition is satisfied are performed S512 and whether a condition considered as an abnormal state of airflow is satisfied S311 is proceeded.

Referring to FIG. 16, at a time point t0 of the dry start step S200, the RPM of fan motor 52 starts to be operated at a n low-level base RPM ($R_{ilow,n}$) The abnormal state of airflow is continued between time points t0 and t1, and thus it is determined that airflow is in an abnormal state at the time point t1, and the RPM of fan motor 52 is increased to a first increase RPM ($R_{p(n,1)}$). While the fan motor 52 is rotating at the first increase RPM ($R_{p(n,1)}$), the abnormal state of airflow (X) is continued between time points t1 and t2. Accordingly, it is determined that airflow is in an abnormal state at the time point t2, and the RPM of fan motor 52 is increased to a second increase RPM ($R_{p(n,2)}$). While the fan motor 52 is rotating at the second increase RPM ($R_{p(n,2)}$), the abnormal state of airflow (X) is continued between time points t2 and t3. Accordingly, it is determined that airflow is in an abnormal state at the time point t3, and the RPM of fan motor 52 is increased to a third increase RPM ($R_{p(n,3)}$)). While the fan motor 52 is rotating at the third increase RPM ($R_{p(n,3)}$)), the abnormal state of airflow (X) is continued between time points t3 and t4. Accordingly, it is determined that airflow is in an abnormal state at the time point t4, and the RPM of fan motor 52 is increased to a fourth increase RPM ($R_{p(n,4)}$). The fourth increase RPM ($R_{p(n,4)}$) is less than or equals to a critical RPM ($R_{lim}$), and if it is determined that airflow is in an abnormal state in a state where the RPM of fan motor 52 has been increased to the fourth increase RPM ($R_{p(n,4)}$), the RPM of fan motor 52 might have been additionally increased, but in the situation of FIG. 16, the abnormal state of airflow is removed from time point t5 in which the RPM has reached the fourth increase RPM ($R_{p(n,4)}$). Since it is determined that airflow is in a normal state after the time t5, a procedure for determining whether a recovering condition is satisfied 350 is performed. The recovering condition is determined at a time interval Tr in which a command RPM (R(t)) is remained at a constant increase RPM ($R_p$).

Whether the recovering condition is satisfied may be determined by using a fan motor duty value (D) which is proportional to power supplied to the fan motor 52. The recovering condition may include a condition in which the fan motor duty value (D) varies more than a predetermined standard at a time interval Tr in which the fan motor 52 rotates at a constant command RPM (R(t)). The recovering condition may include a condition in which the fan motor duty value (D) varies more than a predetermined standard at a time interval Tr in which a command RPM (R(t)) is remained at a constant increase RPM ($R_p$).

Referring to FIG. 16, in the RPM control step S300, a setting duty value (Ds) may be calculated based on a fan motor duty value (D) detected at a time interval Tr in which the fan motor 52 rotates at a constant command RPM (R(t)). In this preferred embodiment, the setting duty value (Ds) may be calculated from the average of the fan motor duty values corresponding to the starting portion of the time interval Tr. In another preferred embodiment, the setting duty value (Ds) may be a representative value calculated based on a predetermined standard from the average of the fan motor duty values corresponding to the starting portion of the time interval Tr.

Referring to FIG. 16, in the RPM control step S300, a minimum duty value (Dmin) may be calculated which is a minimum value of the fan motor duty values (D) from the starting time point t5 to the current time point of the time interval Tr. The minimum duty value (Dmin) may be updated with the passage of time. In a case where the fan motor duty values (D) at the current time point of the time interval Tr is smaller than the fan motor duty values (D) at a time interval before the current time point, the minimum duty value (Dmin) is updated to the current fan motor duty value (D).

Figure 18A:
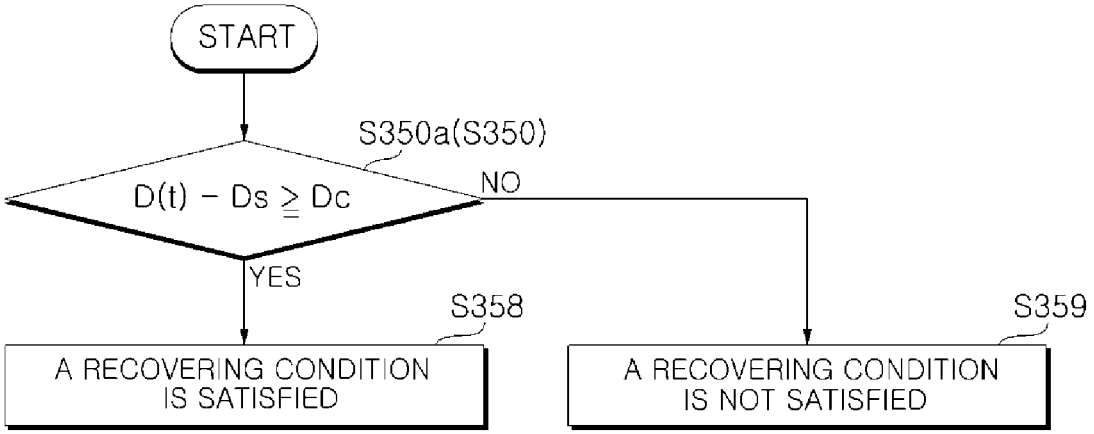
FIGS. 18*a* to 18*d* are flow charts illustrating a step S350 for determining whether the recovering condition of FIG. 15 is satisfied according to an embodiment of the disclosure.

Referring to FIG. 18*a*, the recovering condition may include a reference condition in which a value obtained by subtracting the setting duty value (Ds) from the current duty value (D(t)) is greater than or equals to a predetermined reference duty value (Dc). In the step S350*a* determining whether the reference condition is satisfied, if it is determined that the reference condition is satisfied, it is considered that a recovering condition is satisfied S358, and if it is determined that the reference condition is not satisfied, it is considered that a recovering condition is not satisfied S359. If airflow (F) is increased and the current duty value (D(t)) increases greater than or equals to a setting duty value (Ds) through the reference condition during the time interval Tr, it is determined that the recovering condition is satisfied S358.

Figure 18B:
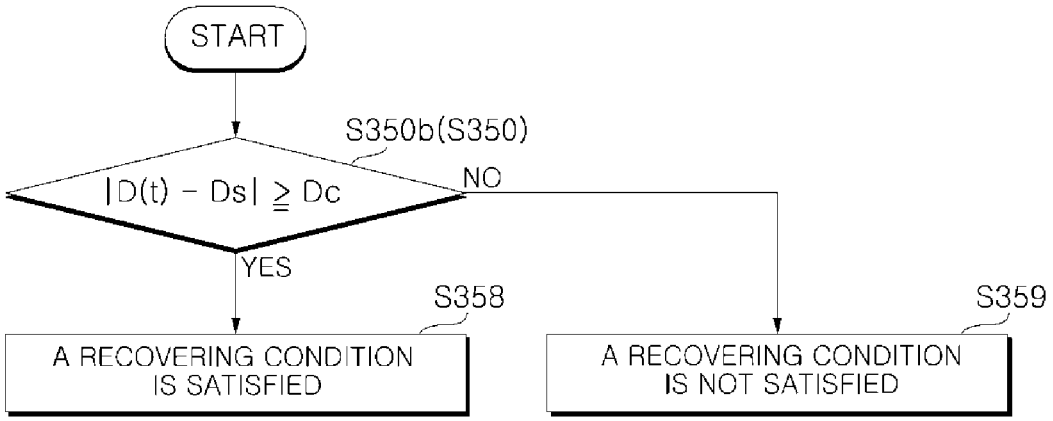

Referring to FIG. 18*b*, the recovering condition may include a reference condition in which a value of difference between the setting duty value (Ds) and the current duty value (D(t)) is greater than or equals to a predetermined reference duty value (Dc). In the step S350*b* determining whether the reference condition is satisfied, if it is determined that the reference condition is satisfied, it is considered that a recovering condition is satisfied S358, and if it is determined that the reference condition is not satisfied, it is considered that a recovering condition is not satisfied S359. Even if the airflow (F) does not necessarily increase but decrease with the passage of time, if the fluctuation width of the airflow is more than or equals to a predetermined reference through the reference condition, it is determined that the recovering condition is satisfied S358.

Figure 18C:
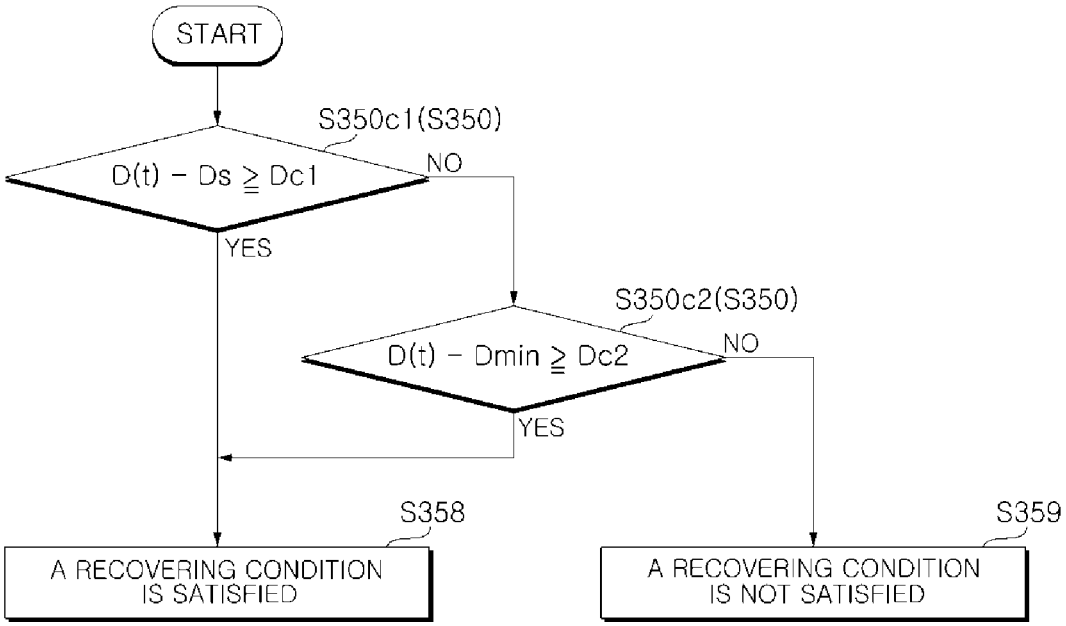

Referring to FIG. 18*c*, the recovering condition may include an additional condition in which a value obtained by subtracting the setting duty value (Ds) from the current duty value (D(t)) is greater than or equals to a predetermined reference duty value (Dc2). The recovering condition may include a union condition satisfying at least one of the reference condition and the additional condition. More specifically, the step S350*c*1 may be a procedure for determining whether a value obtained by subtracting the setting duty value (Ds) from the current duty value (D(t)) is greater than or equals to a predetermined reference duty value (Dc1). As another embodiment, it is possible that the step S350*c*1 may be a procedure for determining whether an absolute value of difference between the setting duty value (Ds) and the current duty value (D(t)) is greater than or equals to a predetermined reference duty value (Dc1). In the step S350*c*1, if the reference condition is satisfied, it is considered that a recovering condition is satisfied S358. In the step S350*c*1, if the reference condition is not satisfied, a procedure for determining whether the additional condition is satisfied is performed S350*c*2. More specifically, the step S350*c*2 may be a procedure for determining whether a value obtained by subtracting the setting duty value (Ds) from the current duty value (D(t)) is greater than or equals to an additional reference duty value (Dc2). As another embodiment, it is possible that the step S350*c*2 may be a procedure for determining whether an absolute value of difference between the setting duty value(Ds) and the current duty value (D(t)) is greater than or equals to an additional reference duty value (Dc2). In the step S350*c*2 for determining of satisfying of the additional reference duty value, if the additional condition is satisfied, it is considered that a recovering condition is satisfied S358, and if the additional condition is not satisfied, it is considered that the recovering condition is not satisfied S359. Wherein, the additional reference duty value (Dc2) is preset to a value greater than the reference duty value (Dc1).

Figure 18D:
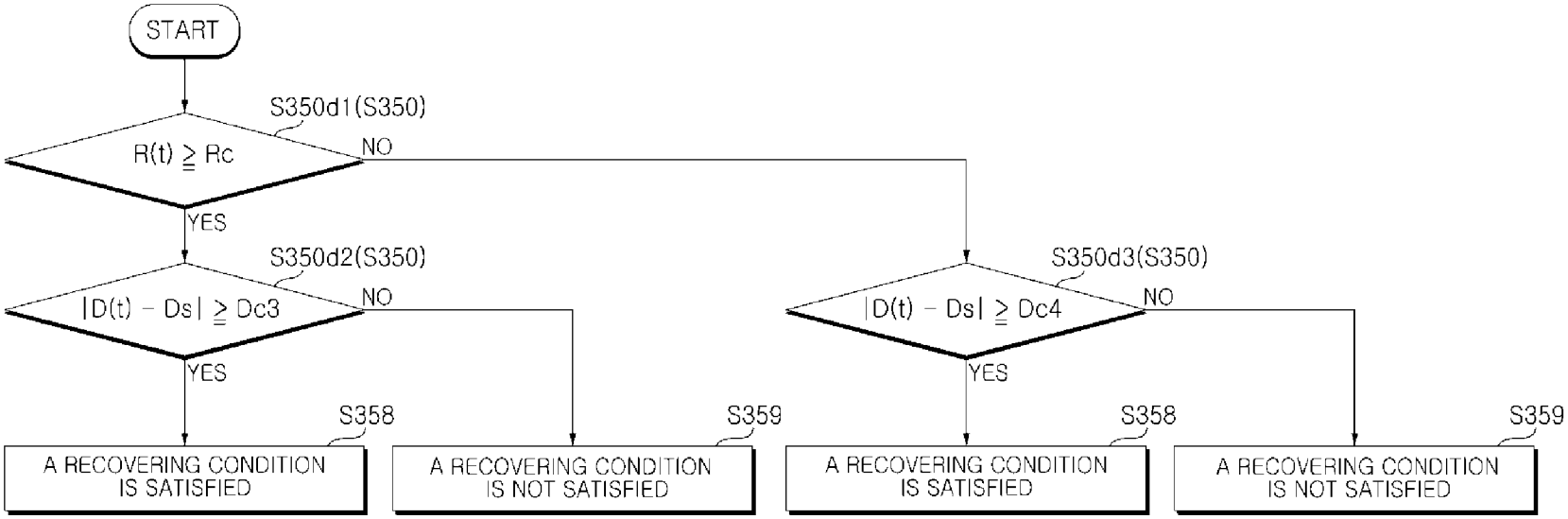

Referring to FIG. 18*d*, reference duty values (Dc3, Dc4) may be preset to be varied based on the current command RPM (R(t)). The reference duty values may be applied differentially based on the command RPM (R(t)). In a case where the command RPM (R(t)) is relatively large, the reference duty value (Dc3) may be preset to a relatively large value, and in a case where the command RPM (R(t)) is relatively small, the reference duty value (Dc4) may be preset to a relatively small value. A level of the current command RPM (R(t)) may be divided based on the preset reference RPM (Rc). For example, the reference duty value may be applied differentially according to results from performing a procedure for determining whether the command RPM (R(t)) is more than or equals to the reference RPM (Rc).

In the step S350*d*1, if it is determined that the command RPM (R(t)) is relatively large, a relatively large reference duty value may be applied for the reference condition and/or the additional condition. For example, in the step S350*d*1, if it is determined that the level of the command RPM (R(t)) is relatively large, a procedure for determining whether a value of difference between the setting duty value (Ds) and the current duty value (D(t)) is greater than or equals to the reference duty value (Dc3) is performed S350*d*2. Wherein, the reference duty value (Dc3) is larger than the reference duty value (Dc4). In the step S350*d*2, if the reference condition is satisfied, it is considered that a recovering condition is satisfied S358, and if the reference condition is not satisfied, it is considered that the recovering condition is not satisfied S359.

In the step S350*d*1, if it is determined that the command RPM (R(t)) is relatively small, a relatively small reference duty value may be applied for the reference condition and/or the additional condition. For example, in the step S350*d*1, if it is determined that the level of the command RPM (R(t)) is relatively small, a procedure for determining whether a value of difference between the setting duty value(Ds) and the current duty value (D(t)) is greater than or equals to the reference duty value (Dc4) is performed S350*d*3. In the step S350*d*3, if the reference condition is satisfied, it is considered that a recovering condition is satisfied S358, and if the reference condition is not satisfied, it is considered that the recovering condition is not satisfied S359.

Referring to FIG. 16, the reference condition is not satisfied until before time point t6 of the time interval Tr. More specifically, a value obtained by subtracting the setting duty value(Ds) from the current duty value (D(t)) in no way is greater than or equals to the reference duty value (Dc) until before time point t6 of the time interval Tr. Moreover, the additional condition is not satisfied until before time point t6 of the time interval Tr. More specifically, a value obtained by subtracting the setting duty value(Ds) from the current duty value (D(t)) in no way is greater than or equals to an additional reference duty value (Dc2) until before time point t6 of the time interval Tr. In time point t6, the reference condition and/or the additional condition are satisfied, and as a result, it is considered that a recovering condition is satisfied. In time point t6, the command RPM (R(t)) is decreased to an n low-level base RPM ($R_{ilow,n}$). An actual RPM is decreased between the time points t6 and t7. After the time point t6, the airflow is maintained in a normal state, and the RPM of fan motor 52 is continually maintained at the n low-level base RPM ($R_{ilow,n}$).

The controller 31 may perform the control method. The controller 31 is configured to cause the fan motor 52 to rotate at a predetermined base RPM ($R_i$)) and the laundry to be dried, and cause the RPM of the fan motor 52 to be increased if it is detected that airflow is in an abnormal state by the abnormal airflow detection unit 80 while the fan motor 52 is rotating.

In a case where the controller 3*l* has caused the fan motor 52 to rotate at a low-level base RPM ($R_{ilow}$) and the laundry to be dried, if it is detected that airflow is in an abnormal state, the controller 3*l* is configured to cause the RPM of the fan motor 52 to be increased, and in a case where the controller 3*l* has caused the fan motor 52 to rotate at a maximum base RPM ($R_{imax}$) and the laundry to be dried, if it is detected that airflow is in an abnormal state, the controller 31 is configured to control performing of an operation responsive to the error.

The controller 31 is configured to cause the RPM of fan motor 52 to be decreased, if it is determined that a recovering condition is satisfied by determining whether the recovering condition is satisfied, while the fan motor 52 is rotating in a state where the RPM of fan motor 52 is increased, which is more than a base RPM ($R_i$).

What is claimed is:

1. A method for controlling a laundry treatment apparatus that includes a drum configured to receive laundry, an air channel configured to guide air into and out of the drum, a fan disposed at the air channel, and a fan motor configured to drive the fan, the method comprising:

starting a drying operation of the laundry treatment apparatus by rotating the fan motor at a base rotation per minute (RPM); and based on rotation of the fan motor, determining a state of airflow in the air channel of the laundry treatment apparatus after starting the drying operation; and controlling an operation RPM of the fan motor of the laundry treatment apparatus based on the state of airflow, wherein controlling the operation RPM of the fan motor of the laundry treatment apparatus comprises increasing the operation RPM of the fan motor of the laundry treatment apparatus based on a determination that the state of airflow corresponds to a first state.

2. The method according to claim 1, wherein the base RPM includes a plurality of base RPMs, and wherein starting the drying operation comprises:

selecting an initial base RPM from among the plurality of base RPMs based on a predetermined condition, and starting the drying operation by rotating the fan motor at the selected initial base RPM.

3. The method according to claim 2, wherein selecting the initial base RPM comprises:

determining an amount of laundry received in the drum;

selecting a maximum base RPM as the initial base RPM from among the plurality of base RPMs based on a determination that the amount of laundry is greater than a reference amount; and selecting a low-level base RPM as the initial base RPM from among the plurality of base RPMs based on a determination that the amount of laundry is less than or equal to the reference amount, wherein controlling the operation RPM of the fan motor further comprises controlling the operation RPM of the fan motor based on selection of the low-level base RPM, and wherein the method further comprises performing, based on selection of the maximum base RPM, an operation response to an error responsive to a detection of the first state after starting the drying operation.

4. The method according to claim 2, wherein selecting the initial base RPM comprises:

determining an amount of laundry received in the drum;

selecting a maximum base RPM as the initial base RPM from among the plurality of base RPMs based on a determination that the amount of laundry is greater than a reference amount; and selecting a first low-level base RPM or a second low-level base RPM as the initial base RPM from among the plurality of base RPMs based on a determination that the amount of laundry is less than or equal to the reference amount, the second low-level base RPM being less than the maximum base RPM and greater than the first low-level base RPM.

5. The method according to claim 1, wherein increasing the operation RPM comprises increasing the operation RPM in a stepwise manner until the state of airflow reaches a second state that is different from the first state.

6. The method according to claim 5, wherein increasing the operation RPM further comprises increasing the operation RPM based on a determination that the operation RPM is less than a predetermined critical RPM.

7. The method according to claim 1, wherein increasing the operation RPM comprises:

increasing the operation RPM of the fan motor to a first increase RPM;

determining whether the state of airflow corresponds to the first state after increasing the operation RPM to the first increase RPM;

increasing the operation RPM to a second increase RPM that is greater than the first increase RPM based on a determination that the state of airflow corresponds to the first state after increasing the operation RPM to the first increase RPM.

8. The method according to claim 7, wherein increasing the operation RPM comprises increasing the operation RPM from a predetermined (m)th order increase RPM to a predetermined (m+1)th order increase RPM based on a determination that the operation RPM of the fan motor is less than or equal to a predetermined critical RPM.

9. The method according to claim 1, further comprising performing an operation response to an error based on a determination that the state of airflow corresponds to the first state and that the operation RPM of the fan motor is greater than or equal to a predetermined critical RPM.

10. The method according to claim 1, wherein determining the state of airflow in the air channel comprises determining satisfaction of a preset condition corresponding to the first state, and wherein determining satisfaction of the preset condition comprises determining that the state of airflow corresponds to the first state based on a determination that an airflow rate in the air channel is less than or equal to a predetermined value.

11. The method according to claim 1, wherein controlling the operation RPM further comprises:

determining whether a recovery condition is satisfied based on the fan motor rotating at an RPM that is greater than the base RPM; and decreasing the operation RPM based on a determination that the recovery condition is satisfied.

12. The method according to claim 11, wherein decreasing the operation RPM comprises decreasing the operation RPM to the base RPM.

13. The method according to claim 11, wherein determining whether the recovery condition is satisfied comprises determining whether the recovery condition is satisfied based on a determination that the state of airflow corresponds to a second state that is different from the first state.

14. The method according to claim 11, wherein determining whether the recovery condition is satisfied comprises determining whether the recovery condition is satisfied based on a fan motor duty value that is proportional to power supplied to the fan motor.

15. The method according to claim 14, wherein the recovery condition includes a condition in which a variation of the fan motor duty value exceeds a predetermined variation level at a time interval in which the fan motor rotates at a constant command RPM.

16. The method according to claim 14, further comprising:

determining the fan motor duty value at a time interval based on the fan motor rotating at a constant command RPM; and determining a setting duty value based on the fan motor duty value, wherein the recovery condition includes a reference condition in which a value obtained by subtracting the setting duty value from a current fan motor duty value is greater than or equal to a reference duty value.

17. The method according to claim 14, further comprising:

determining the fan motor duty value at a time interval based on the fan motor rotating at a constant command RPM; and determining a setting duty value based on the fan motor duty value, wherein the recovery condition includes a reference condition in which a value corresponding to a difference between the setting duty value and a current fan motor duty value is greater than or equal to a reference duty value.

18. The method according to claim 17, further comprising determining a minimum duty value from fan motor duty values in a time section from a start time point to a present time point, wherein the recovery condition further includes an additional condition in which a value obtained by subtracting the minimum duty value from the current fan motor duty value is greater than or equal to an additional reference duty value.

19. A laundry treatment apparatus comprising:

a drum configured to receive laundry;

an air channel configured to guide air to flow into the drum and flow out of the drum;

a fan configured to apply pressure to air in the air channel to cause flow of air;

a fan motor configured to rotate the fan and control flow of air in the air channel by controlling an operation rotation per minute (RPM) of the fan motor;

an airflow state detector located in the air channel and configured to detect a first state of airflow in the air channel; and a controller configured to:

cause the fan motor to rotate at a base RPM to dry laundry received in the drum, and increase the operation RPM based on the airflow state detector detecting the first state of airflow in a state in which the fan motor rotates at the operation RPM.

20. The laundry treatment apparatus according to claim 19, further comprising a heater configured to heat air that flows into the drum, wherein the airflow state detector includes an airflow switch configured to open or close a portion of the air channel based on airflow in the air channel.

* * * * *